US011097814B2

(12) United States Patent
Wang et al.

(10) Patent No.: US 11,097,814 B2
(45) Date of Patent: Aug. 24, 2021

(54) WATER SURFACE CLEANING MACHINE

(71) Applicants: HANGZHOU GREATSTAR INTELLIGENT TECHNOLOGY CO., LTD., Zhejiang (CN); HANGZHOU GREAT STAR ROBOT TECHNOLOGY CO., LTD., Zhejiang (CN)

(72) Inventors: Weiyi Wang, Hangzhou (CN); Yueming Li, Hangzhou (CN)

(73) Assignees: HANGZHOU GREAT STAR INDUSTRIAL CO., LTD., Hangzhou (CN); HANGZHOU GREATSTAR INTELLIGENT TECHNOLOGY CO., LTD, Hangzhou (CN)

( * ) Notice: Subject to any disclaimer, the term of this patent is extended or adjusted under 35 U.S.C. 154(b) by 174 days.

(21) Appl. No.: 16/473,972

(22) PCT Filed: Jul. 28, 2017

(86) PCT No.: PCT/CN2017/094853
§ 371 (c)(1),
(2) Date: Jun. 26, 2019

(87) PCT Pub. No.: WO2018/120827
PCT Pub. Date: Jul. 5, 2018

(65) Prior Publication Data

US 2021/0129948 A1 May 6, 2021

(30) Foreign Application Priority Data

Dec. 28, 2016 (CN) ..... 201611232079.6
Dec. 28, 2016 (CN) ..... 201621451584.5
(Continued)

(51) Int. Cl.
*E04H 4/12* (2006.01)
*E02B 15/04* (2006.01)
(Continued)

(52) U.S. Cl.
CPC ..... *B63B 35/32* (2013.01); *E02B 15/046* (2013.01); *E02B 15/10* (2013.01); *E02B 15/104* (2013.01); *E04H 4/1263* (2013.01)

(58) Field of Classification Search
CPC ... E04H 4/1263; E04H 4/1654; E02B 15/045; E02B 15/046; E02B 15/10; B63B 35/32
(Continued)

(56) References Cited

U.S. PATENT DOCUMENTS 3,268,081 A * 8/1966 Menkee ..... E02B 15/046 210/242.1
3,585,955 A 6/1971 Celia
(Continued)

FOREIGN PATENT DOCUMENTS

CN 201280713 7/2009
CN 201890340 7/2011
(Continued)

OTHER PUBLICATIONS

International Search Report issued in PCT/CN2017/094853 dated Nov. 9, 2017.
(Continued)

*Primary Examiner* — Christopher Upton
(74) *Attorney, Agent, or Firm* — DLA Piper LLP (US)

(57) ABSTRACT

The present invention provides a water surface cleaning machine, comprising a hull, a cleaning device provided at the bottom of the hull for collecting and storing water surface floating debris, a propulsion device provided at the front end and/or the back end of the hull for propelling the hull to travel on the water surface, a steering device provided
(Continued)

at the corner portion between the front end and the side edge of the hull, wherein steering device causes the hull to rotate relative to an obstacle for adjusting traveling direction of the hull when the hull comes into contact with the obstacle during traveling on the water surface, and a power unit provided inside the hull for providing power to the propulsion device and the steering device.

15 Claims, 13 Drawing Sheets

(30) Foreign Application Priority Data

| | | |
|---|---|---|
| Dec. 28, 2016 | (CN) | 201621453051.0 |
| Dec. 28, 2016 | (CN) | 201621453089.8 |
| Dec. 28, 2016 | (CN) | 201621459393.3 |
| Dec. 31, 2016 | (CN) | 201611267682.8 |
| Dec. 31, 2016 | (CN) | 201621488380.9 |

(51) Int. Cl.
*B63B 35/32* (2006.01)
*E02B 15/10* (2006.01)

(58) Field of Classification Search
USPC ..... 210/167.1, 167.2, 170.05, 170.09, 242.1, 210/747.6, 776
See application file for complete search history.

(56) References Cited

U.S. PATENT DOCUMENTS

| | | | | |
|---|---|---|---|---|
| 3,860,518 | A * | 1/1975 | Henricksen | E04H 4/1263 210/776 |
| 4,033,876 | A | 7/1977 | Cocjin et al. | |
| 4,900,432 | A * | 2/1990 | Arnold | E04H 4/1263 210/167.1 |
| 5,043,060 | A * | 8/1991 | Brennan | E04H 4/1609 210/167.2 |
| 5,106,492 | A * | 4/1992 | Distinti | E04H 4/1263 210/242.1 |
| 7,101,475 | B1 | 9/2006 | Maaske et al. | |
| 9,976,271 | B2 * | 5/2018 | Casadio | E04H 4/1263 |
| 2006/0060513 | A1 * | 3/2006 | Craig | E04H 4/1263 210/167.2 |

FOREIGN PATENT DOCUMENTS

| | | |
|---|---|---|
| CN | 202414122 | 9/2012 |
| CN | 203876955 | 10/2014 |
| CN | 204780825 | 11/2015 |
| CN | 105667724 | 6/2016 |
| CN | 206288205 | 6/2017 |
| CN | 206289606 | 6/2017 |
| EP | 1177973 | * 2/2002 |

OTHER PUBLICATIONS

Chinese Office Action issues in Application No. 201611232079.6 dated Dec. 18, 2019.

* cited by examiner

WATER SURFACE CLEANING MACHINE

CROSS REFERENCE TO RELATED APPLICATIONS

This application is a U.S. National Stage Application of International Application No. PCT/CN2017/094853 filed Jul. 28, 2017, which claims priority from China Patent Application No. CN2016/21488380.9 filed Dec. 31, 2016, from China Patent Application No. CN2016/21459393.3 filed Dec. 28, 2016, China Patent Application No. CN2016/21453051.0 filed Dec. 28, 2016, China Patent Application No. CN2016/21451584.5 filed Dec. 28, 2016, China Patent Application No. CN2016/21453089.8 filed Dec. 28, 2016, China Patent Application No. CN2016/11267682.8 filed Dec. 31, 2016 and China Patent Application No. CN2016/11232079.6 filed Dec. 28, 2016. The entirety of all the above-listed applications are incorporated herein by reference.

FIELD OF THE INVENTION

The present invention relates to a water surface floating debris cleaning equipment, and in particular to a water surface cleaning machine.

DESCRIPTION OF THE PRIOR ART

U.S. Patent Document U.S. Pat. No. 7,101,475B1 discloses a technical solution of "Autonomously Navigating Solar Swimming Pool Skimmer", which can be used to automatically clean the debris floating on the water surface of the swimming pool. In order to facilitate turning when contacting an obstacle (such as the wall of the swimming pool), a power buffer which rotates during operation is provided in this solution, and once the power buffer comes into contact with the obstacle, the obstacle will apply an acting force on the skimmer via the power buffer to steer the skimmer so as to bypass the obstacle.

The power buffer is specifically embodied as a rotating wheel, the probability that the rotating wheel directly contacts the obstacle is small due to the small diameter of the rotating wheel, and thus it is likely that the hull contacts the obstacle, but the rotating wheel cannot contact the obstacle, thereby causing the skimmer to fail to turn. Meanwhile, with the edge of the rotating wheel contacting the obstacle, and the contact area and the friction coefficient between them being small, it happens easily that the rotating wheel slips on the obstacle, and the force applied on the skimmer by the obstacle is not enough to make the skimmer away from the obstacle, thereby causing the skimmer to fail to turn. Furthermore, when two rotating wheels contact the obstacle (such as the pool wall of the swimming pool) simultaneously, since the rotation directions of the two rotating wheels are opposite, the directions of the acting forces applied on the two rotating wheels by the obstacle are opposite, which acting forces are partly or completely offset, thereby causing the skimmer to fail to turn and to be difficult to deviate from the obstacle.

The other disadvantages of this technical solution are that the skimmer uses two sets of gear motors simultaneously to control the front and back propellers respectively, the overall mass is great, the energy consumption is large, and the buoyancy requirement is high. The opening of the slag box of the skimmer is large, the garbage within the slag box may float out under the action of the water flow, and the cleaning effect is poor.

SUMMARY OF THE INVENTION

An object of the present invention is to provide a water surface cleaning machine for solving technical problems of the prior art water surface cleaning machines such as difficult to turn when encountering an obstacle, large energy consumption, poor cleaning effect, etc.

In order to solve the above-mentioned technical problems, the present invention provides a water surface cleaning machine including: a hull; a cleaning device provided at the bottom of the hull for collecting and storing water surface floating debris; a propulsion device provided at the front end and/or the back end of the hull for propelling the hull to travel on the water surface; a steering device provided at the corner portion between the front end and the side edge of the hull; the steering device causes the hull to rotate relative to an obstacle for adjusting traveling direction of the hull when the hull comes into contact with the obstacle during traveling on the water surface; and a power unit provided inside the hull for providing power to the propulsion device and the steering device.

Further, in a different implementation, the hull includes a hull plate; a housing assembled over the hull plate; an assembly space defined by the housing and the hull plate; two buoyancy tanks provided on the left and right sides below the hull plate and extending in the forward and backward directions; and a water passage defined by the two buoyancy tanks and the hull plate.

Further, in a different implementation, the cleaning device includes a slag box inserted into the water passage from the front end of the hull and detachably assembled to the hull.

Further, in a different implementation, the slag box includes a slag box bottom plate; two oppositely disposed slag box side plates perpendicular to the slag box bottom plate; a slag box front plate, the height of the upper edge of which is lower than the height of the upper edge of the slag box side plates; a water inlet of the slag box is formed between the upper edge of the slag box front plate and the hull; a slag box back plate perpendicular to the slag box bottom plate; and a filter screen provided on the slag box bottom plate and/or the slag box back plate.

Further, in a different implementation, the cleaning device further includes two slag box slide grooves recessed down to the outer side walls of the two slag box side plates respectively; two slag box slide guides protruding from the side walls of the two buoyancy tanks on both sides of the water passage respectively and slidably assembled to the two slag box slide grooves; two slag box bayonets provided in the upper portion of the back end of the two slag box side plates respectively; and a slag box baffle protruding downward from the bottom of the hull plate; the slag box slide guides slide along the slag box slide grooves when the slag box is inserted into the water passage; the slag box baffle is snapped into the slag box bayonets when the slag box is assembled to the hull.

Further, in a different implementation, the cleaning device includes a non-return sheet provided at the water inlet of the water passage and extending across the water passage; the upper end of the non-return sheet is rotatably assembled to the bottom of the hull and the lower end thereof is rotatable forward and backward.

Further, in a different implementation, the cleaning device includes a non-return sheet baffle protruding from the slag box bottom plate and disposed opposite to the non-return sheet; the height of the lower edge of the non-return sheet is smaller than that of the upper edge of the non-return sheet baffle when the center of gravity of the non-return sheet is at the lowest point; the non-return sheet is blocked by the non-return sheet baffle at the lowest point of the center of gravity when the center of gravity of the non-return sheet is moved from a high position to a low position.

Further, in a different implementation, the cleaning device includes a gathering sweeping member protruding from the corner portion between the front end and the side edge of the hull.

Further, in a different implementation, the gathering sweeping member is a hairbrush which includes: a brush holder detachably assembled to the hull; and bristles fixed to one side of the brush holder and extending in a front-down direction of the hull; alternatively, the gathering sweeping member is any one of a sponge, EVA material or gauze.

Further, in a different implementation, the power unit includes a gear motor for outputting a torque; a first torque transmission mechanism for transmitting the torque outputted from the gear motor to the propulsion device; and a second torque transmission mechanism for transmitting the torque outputted from the gear motor to the steering device; wherein the steering device and the propulsion device introduce a torque synchronously and move in synchronism.

Further, in a different implementation, the gear motor is located on the left or right side of the hull; the gear motor includes a power output shaft extending in the forward and backward directions of the hull, both ends of the power output shaft are connected to one propulsion device via one first torque transmission mechanism respectively.

Further, in a different implementation, the first torque transmission mechanism includes two transmission shafts rotatably assembled to the hull and respectively connected to both ends of the propeller rotary shaft of the propulsion device; a worm provided at one end of the power output shaft; and a worm gear fixed to one transmission shaft and drivingly engaged with the worm.

Further, in a different implementation, the water surface cleaning machine further includes a transmission shaft bracket provided on the lower surface of the hull plate and perpendicular to the hull plate; a transmission shaft mounting hole is provided in the middle of the transmission shaft bracket, and one transmission shaft is rotatably assembled into the transmission shaft mounting hole.

Further, in a different implementation, the first torque transmission mechanism further includes a torque transmission slide groove provided in the end cap connector of the propulsion device; and a torque transmission bump protruding from the surface of one end of the transmission shaft and snapped into the torque transmission slide groove.

Further, in a different implementation, the second torque transmission mechanism includes a first bevel gear and a second bevel gear, the first bevel gear includes first tapered gear teeth; and a first bevel gear shaft fixedly connected to one transmission shaft; the second bevel gear includes second tapered gear teeth drivingly engaged the first bevel gear shaft; and a second bevel gear shaft perpendicular to the first bevel gear shaft and connected to the driving wheel of the steering device.

Further, in a different implementation, the propulsion device includes a propeller rotary shaft rotatably assembled to the bottom of the hull; the propeller rotary shaft is connected to the gear motor via the first torque transmission mechanism to introduce a torque; and at least one vane radially and evenly distributed on the side wall of the propeller rotary shaft; the lower half of the propulsion device is below the water surface when the hull floats on the water surface; and the vane pushes water when the propeller rotary shaft rotates.

Further, in a different implementation, both ends of the propeller rotary shaft are connected to one transmission shaft, respectively; the central axes of the two transmission shafts are on the same straight line as the central axis of the propeller rotary shaft.

Further, in a different implementation, the propeller rotary shaft includes a rotary shaft through hole extending from one end through the other end of the propeller rotary shaft; a first telescopic shaft provided in the middle of the rotary shaft through hole; a first elastic member provided within the rotary shaft through hole and connected to one end of the first telescopic shaft; wherein one of the transmission shafts is inserted into the rotary shaft through hole from one end of the propeller rotary shaft and is connected to the first elastic member.

Further, in a different implementation, the propeller rotary shaft includes a rotary shaft through hole extending from one end through the other end of the propeller rotary shaft; a first telescopic shaft provided in the middle of the rotary shaft through hole; a second elastic member provided within the rotary shaft through hole and connected to one end of the first telescopic shaft; a second telescopic shaft partly provided within the rotary shaft through hole, one end thereof being connected to the second elastic member and the other end thereof extending beyond the rotary shaft through hole and being connected to one transmission shaft through the end cap through hole of one rotary shaft end cap.

Further, in a different implementation, the propulsion device further includes a vane socket fixed to the propeller rotary shaft; the vane socket is provided with at least one vane mounting position, and the vane is assembled to the vane mounting position; and/or two rotary shaft end caps fixed to both ends of the propeller rotary shaft, including: an end cap body; an end cap through hole extending through the center of the end cap body; an end cap bayonet provided at the edge of the end cap body for snapping the vane; and an end cap connector provided on the side of the end cap body remote from the propeller rotary shaft for connecting the transmission shaft.

Further, in a different implementation, the vane is curved; the bending direction of the vane coincides with the rotation direction of the propeller rotary shaft when the hull travels forward.

Further, in a different implementation, the steering device is provided at the left front end and/or the right front end of the hull, and includes: a transmission wheel set provided at the corner portion between the front end and the left side edge and/or the right side edge of the hull; an endless track enclosing the transmission wheel set and being in a tensioned state, a segment of the endless track is positioned at one corner portion by the transmission wheel set and protrudes from the hull.

Further, in a different implementation, the steering device includes a bevel gear mounting frame disposed opposite to a portion of the endless track and fixedly connected to the hull; the bevel gear mounting frame includes: a first bevel gear mounting hole in which a first bevel gear is rotatably assembled; and a second bevel gear mounting hole in which a second bevel gear is rotatably assembled.

Further, in a different implementation, the transmission wheel set includes: a driving wheel connected to the transmission shaft via the second torque transmission mechanism to introduce a torque; a front bogie wheel provided at the foremost end of the hull; and a corner bogie wheel provided at the leftmost or rightmost end of the front portion of the hull; wherein, a portion of the outer surface of the driving wheel, the front bogie wheel and the corner bogie wheel is tangent to the inner surface of the endless track.

Further, in a different implementation, the steering device includes a wheel set mounting plate disposed opposite to the endless track and fixedly connected to the hull; the driving wheel, the front bogie wheel and the corner bogie wheel are rotatably assembled to the wheel set mounting plate.

Further, in a different implementation, the steering device includes a locating bogie wheel rotatably assembled to the wheel set mounting plate; a portion of the outer surface thereof is tangent to the outer surface of the endless track.

Further, in a different implementation, the projections of the central axis of the driving wheel, the central axis of the front bogie wheel and the central axis of the corner bogie wheel on the wheel set mounting plate define a triangular region; the projection of the central axis of the locating bogie wheel on the wheel set mounting plate is within the triangular region.

Further, in a different implementation, the steering device includes a driving wheel mounting shaft vertically fixed to the wheel set mounting plate, the driving wheel is rotatably disposed outside the driving wheel mounting shaft; a front bogie wheel mounting shaft vertically fixed to the wheel set mounting plate, the front bogie wheel is rotatably disposed around the outside of the front bogie wheel mounting shaft; and a locating bogie wheel mounting shaft vertically fixed to the wheel set mounting plate, the locating bogie wheel is rotatably disposed around the outside of the locating bogie wheel mounting shaft.

Further, in a different implementation, the steering device further includes a corner bogie wheel mounting shaft vertically fixed to the wheel set mounting plate, the corner bogie wheel is rotatably disposed around the outside of the corner bogie wheel mounting shaft.

Further, in a different implementation, the steering device further includes: a first axle mounting plate provided at the edge of the wheel set mounting plate and protruding from the corner portion; and a second axle mounting plate provided at the edge of the bevel gear mounting frame, protruding from the corner portion and disposed opposite to the first axle mounting plate; wherein the corner bogie wheel is rotatably assembled to the first axle mounting plate and the second axle mounting plate; a portion of the wheel wall of the corner bogie wheel is exposed outside of the first axle mounting plate and the second axle mounting plate.

Further, in a different implementation, the steering device further includes: a first axle mounting hole extending through the edge of the first axle mounting plate; and a second axle mounting hole extending through the edge of the second axle mounting plate and disposed opposite to the first axle mounting hole; the corner bogie wheel includes: a corner bogie wheel middle section which is a round pillar having one end rotatably assembled to the first axle mounting hole and the other end rotatably assembled to the second axle mounting hole; and two corner bogie wheel baffles respectively provided at both ends of the corner bogie wheel middle section, and respectively provided on the outer side of the first axle mounting plate and the second axle mounting plate; wherein a portion of the wheel wall of the corner bogie wheel middle section is exposed outside of the first axle mounting hole and the second axle mounting hole, and is coated by a segment of the endless track.

Further, in a different implementation, the first axle mounting hole has an arcuate cross section, the side wall of which is provided with a first axle mounting plate opening; the second axle mounting hole has an arcuate cross section, the side wall of which is provided with a second axle mounting plate opening; wherein a portion of the wheel wall of the corner bogie wheel passes through the first axle mounting plate opening and the second axle mounting plate opening and is exposed outside of the hull.

Further, in a different implementation, the corner bogie wheel is inclined by the pressure of the endless track; in the inclined state, the central axis of the corner bogie wheel forms an angle of 2 to 5 degrees with respect to the vertical direction.

Further, in a different implementation, the front bogie wheel is provided between the middle point of the front end of the hull and the corner bogie wheel; the distance between the front bogie wheel and the corner bogie wheel is greater than the distance between the front bogie wheel and the middle point of the front end of the hull.

Further, in a different implementation, the inner surface of the endless track is provided with engaging teeth; the driving wheel is a toothed pulley; the endless track is drivingly engaged with the toothed pulley via the engaging teeth.

Further, in a different implementation, the water surface cleaning machine further includes an anti-skid device provided at the corner portion between the back end and the side edge of the hull and protruding from the back end and/or the side edge of the hull.

Further, in a different implementation, the anti-skid device is attached to the back end and left and/or right side walls of the hull; and/or, the anti-skid device is made of an elastic material; and/or, the outer surface of the anti-skid device is provided with a rough surface.

The beneficial effect of the present invention is that a water surface cleaning machine is provided, which can be operated freely on the water surface and complete a certain range of water area cleaning during traveling, and the cleaning effect is good; the present invention can bypass the obstacle on the water surface during traveling, so that the obstacle will not affect the normal operation of the water surface cleaning machine. This embodiment can turn by itself to bypass the obstacle on the water surface during traveling, thereby avoiding skidding, failing to turn, and failing to move. This embodiment uses only a set of motors to provide power to the propulsion device and the steering device, which can reduce the production cost, reduce the overall weight, and effectively reduce the energy consumption.

Figure 1:
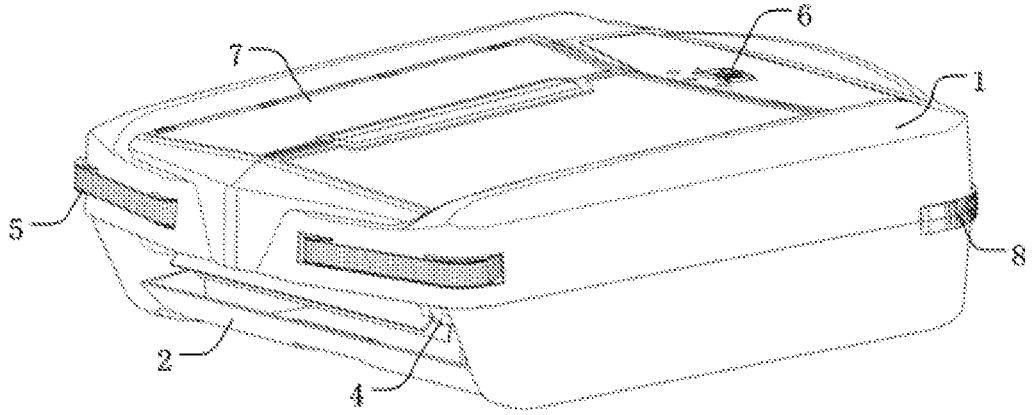
FIG. 1 is an overall structural schematic view of Embodiment 1 of the present invention.

The reference numerals of the components in the figures are as follows:

1 hull, 2 cleaning device, 3 power unit, 4 propulsion device, 5 steering device, 6 control device, 7 power supply device, 8, anti-skid device;

11 hull plate, 12 housing, 13 assembly space, 14 buoyancy tank, 15 water passage; 21 slag box, 22 gathering sweeping member;

31 gear motor, 32 first torque transmission mechanism, 33 second torque transmission mechanism, 34 transmission shaft bracket;

41 propeller rotary shaft, 42 vane, 43 vane socket, 44 rotary shaft end cap;

51 transmission wheel set, 52 endless track, 53 bevel gear mounting frame, 54 wheel set mounting plate, 55 first axle mounting plate, 56 second axle mounting plate;

61 switch, 62 circuit board, 71 rechargeable battery, 72 solar panel;

111 slag box baffle, 141 slag box slide guide, 113 housing slide block;

211 slag box bottom plate, 212 slag box side plate, 213 slag box front plate, 214 slag box back plate;

215 slag box slide groove, 216 slag box bayonet, 217 non-return sheet, 218 non-return sheet baffle;

311 motor, 312 speed reducer, 313 power output shaft;

321 transmission shaft, 322 worm, 323 worm wheel, 324 torque transmission bump, 325 torque transmission slide groove;

331 first bevel gear, 332 second bevel gear, 341 transmission shaft mounting hole;

411 rotary shaft through hole, 412 first elastic member, 413 first telescopic shaft, 414 second elastic member, 415 second telescopic shaft;

431 vane mounting position, 441 end cap body, 442 end cap through hole, 443 end cap bayonet, 444 end cap connector;

511 driving wheel, 512 front bogie wheel, 513 corner bogie wheel, 514 locating bogie wheel;

521 rack, 531 first bevel gear mounting hole, 532 second bevel gear mounting hole;

541 driving wheel mounting shaft, 542 front bogie wheel mounting shaft, 543 corner bogie wheel mounting shaft, 544 locating bogie wheel mounting shaft;

551 first axle mounting hole, 561 second axle mounting hole;

3311 first tapered gear teeth, 3312 first bevel gear shaft, 3321 second tapered gear teeth, 3322 second bevel gear shaft

5131 corner bogie wheel middle section, 5132 corner bogie wheel baffle, 5133 central axis of corner bogie wheel, 5134 plumb line in the vertical direction.

DETAILED DESCRIPTION OF THE PREFERRED EMBODIMENTS

The preferred embodiments of the present invention will be described fully hereafter with reference to the accompanying drawings of the description, so that the technical contents thereof will be more clearly and easily understood. The present invention may be embodied in many different forms of embodiments, the scope of which is not limited to the embodiments mentioned herein.

In the drawings, the components having the same structures are denoted by the same reference numerals, and the components having similar structures or functions are denoted by similar reference numerals. The dimension and thickness of each of the components shown in the drawings are shown arbitrarily, and the present invention does not limit the dimension and thickness of each of the components. In order to make the illustration clearer, the thickness of the component is appropriately exaggerated in some places in the drawings.

The directional words mentioned in the present invention, such as upper, lower, front, back, left, right, inner, outer, side, top, bottom, top end, bottom end, end, etc., are only the directions in the drawings and are only intended to explain and illustrate the present invention, but not to limit the scope of protection of the present invention.

When a certain component is described as being "on" another component, the component may be placed directly on another component; an intermediate component may also be present, the component is placed on the intermediate component, and the intermediate component is placed on another component. When a component is described as being "assembled to" or "connected to" another component, the two may be understood to be directly "assembled" or "connected", or one component is indirectly "assembled to" or "connected to" another component via an intermediate component.

Embodiment 1

Figure 2:
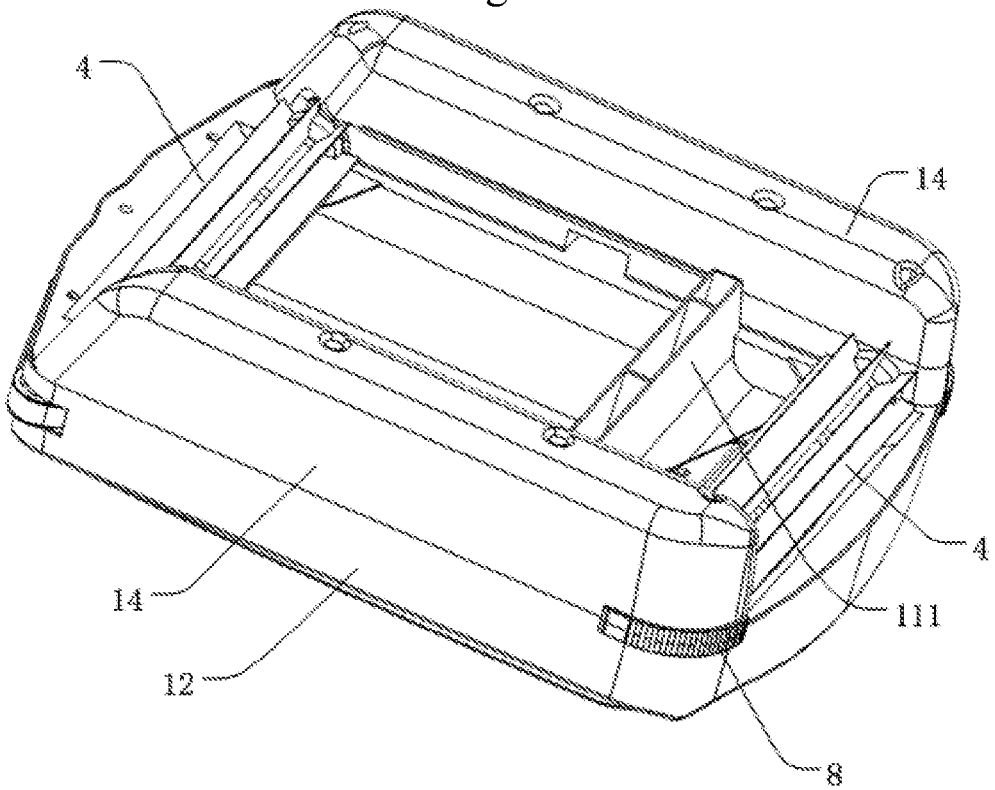
FIG. 2 is a structural schematic view of a bottom surface in Embodiment 1 of the present invention with the slag box removed.

As shown in FIGS. 1 to 2, this embodiment provides a water surface cleaning machine, including a hull 1, a cleaning device 2, a power unit 3, a propulsion device 4, and a steering device 5.

The water surface cleaning machine according to this embodiment has a main structure which is the hull 1 and can float on the water surface. The cleaning device 2 is provided at the bottom of the hull 1 for collecting and storing water surface floating debris. The propulsion device 4 is provided at the front end and/or the back end of the hull 1 for propelling the hull 1 to travel on the water surface. The steering device 5 is provided at the corner portion between the front end and the side edge of the hull 1; when the hull 1 comes into contact with an obstacle on the water surface during traveling, the steering device 5 causes the hull 1 to rotate relative to the obstacle for adjusting traveling direction of the hull 1. The power unit 3 is provided inside the hull 1, the main body thereof is a gear motor for providing power to the propulsion device 4 and the steering device 5, so that the propulsion device 2 and the steering device 3 are operated simultaneously and move in synchronism.

This embodiment further includes a control device 6, a power supply device 7, and an anti-skid device 8. The control device 6 is provided inside the hull 1 for planning the traveling path of the hull 1 and controlling the start and stop of the power unit 3. The power supply device 7 is provided inside the hull 1, which is a rechargeable battery for supplying power to the power unit 3. The anti-skid device 8 is provided at the corner portion between the back end and the side edge of the hull 1 and protrudes from the back end and/or the side edge of the hull 1.

Figure 3:
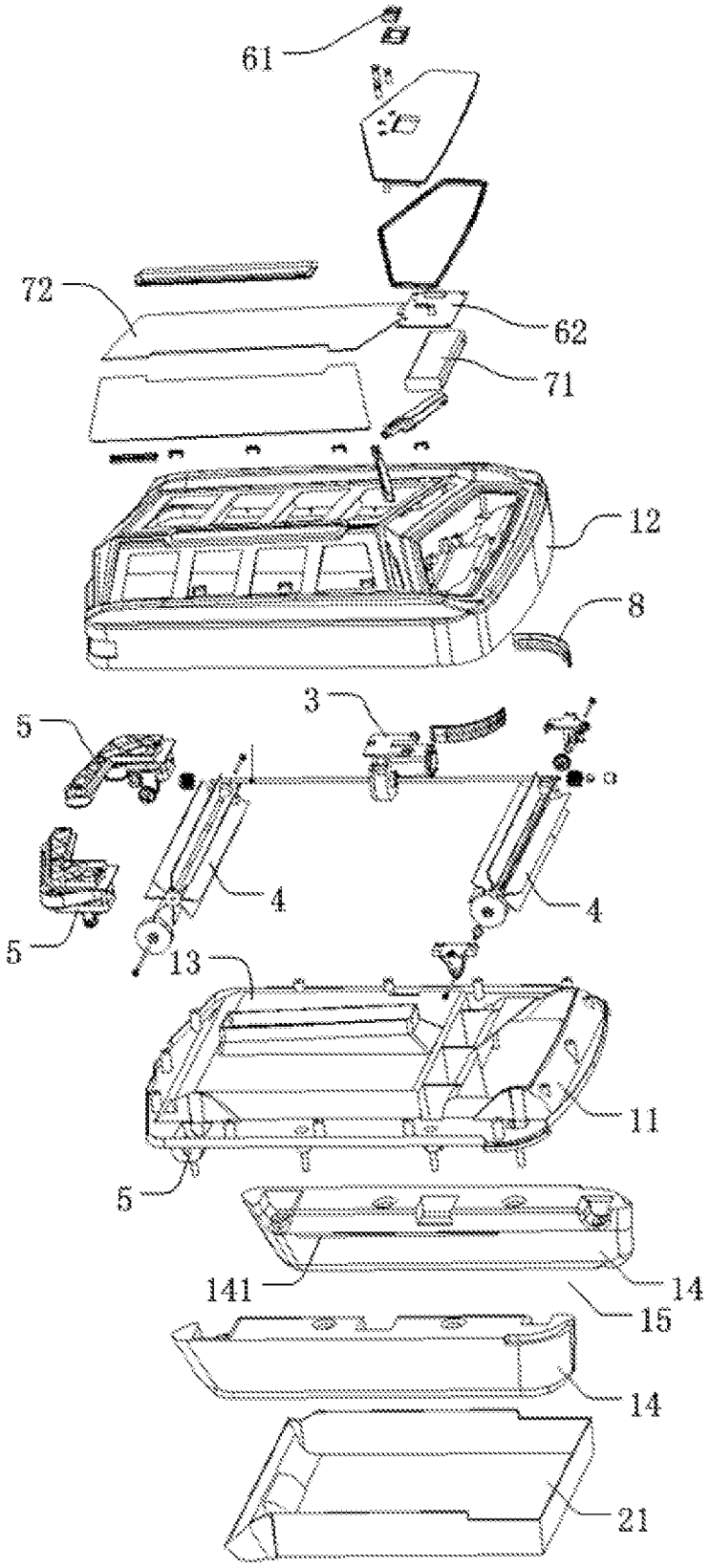
FIG. 3 is an exploded structural schematic view of Embodiment 1 of the present invention.

As shown in FIGS. 1 to 3, the hull 1 includes a hull plate 11 and a housing 12 assembled over the hull plate 11, and an assembly space 13 is defined by the housing 12 and the hull plate 11. Preferably, the assembly space 13 is a closed space, and the power unit 4 and the control device 5 are provided within the assembly space 13. The hull 1 further includes two buoyancy tanks 14 provided on the left and right sides below the hull plate 11 and extending in the forward and backward directions; the forward and backward directions here refer to the forward and backward directions in which the hull 1 travels. The main structure of the power unit 4 includes a gear motor provided on the left or right side of the hull 1, and the buoyancy force received by the buoyancy tank 14 located below the gear motor is greater than the buoyancy force received by the other buoyancy tank 14. The two buoyancy tanks 14 and the hull plate 11 define a water passage 15, i.e., the space between the two buoyancy tanks 14, above the water passage is the hull plate 11, and the lower half of the water passage 15 is below the water surface.

The cleaning device 2 is provided at the bottom of the hull 1 for collecting and storing water surface floating debris. The cleaning device 2 includes a slag box 21 which is inserted into the water passage 15 from the front end of the hull 1 and is detachably assembled to the hull 1.

Figure 4:
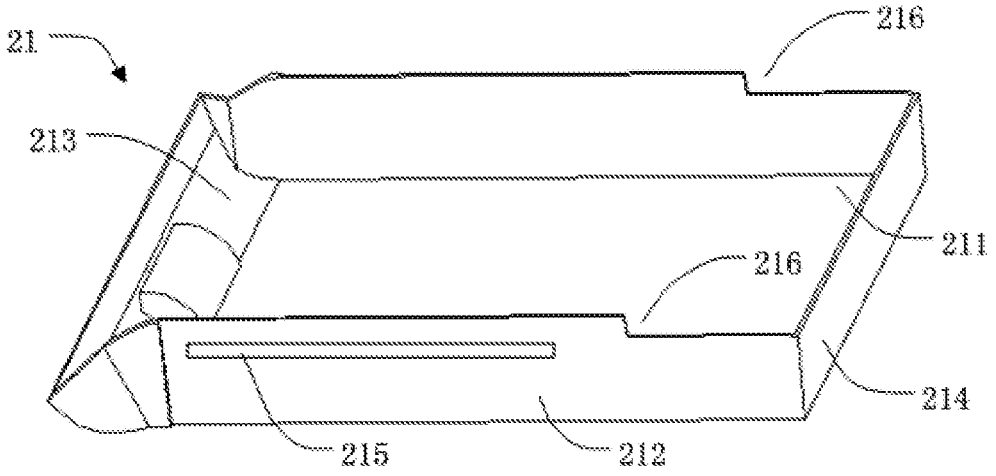
FIG. 4 is a structural schematic view of the slag box according to Embodiment 1 of the present invention.

As shown in FIG. 4, the slag box 21 includes a slag box bottom plate 211 and two slag box side plates 212 which are oppositely disposed, located on the left and right sides of the hull, and are perpendicular to the slag box bottom plate 211. The slag box 21 further includes a slag box front plate 213 and a slag box back plate 214, the height of the slag box front plate 213 is lower than that of the slag box side plates 212; and a water inlet of the slag box 21 is formed between the upper edge of the slag box front plate 213 and the hull 1. When the water surface cleaning machine according to this embodiment travels on the water surface, the debris on the water surface enters the slag box 21 under the action of water flow. The slab box front plate 213 may be an inclined flat plate, the angle formed by the planes where the slag box front plate 213 and the slag box bottom plate 211 are located is in the range of 30 to 60 degrees; or the slab box front plate 213 may be a curved arc-shaped plate, a smooth arc-shaped surface is formed between the upper edge of the slag box front plate 213 and the slag box bottom plate 211, the longitudinal section of the arc-shaped surface is an arc. Since the slag box front plate 213 is provided at the front end of the hull 1, during the traveling of the hull 1, the outer side of the slag box front plate 213 will be subjected to the resistance generated by the water, the inclined or arc-shaped arrangement of the slag box front plate 213 may better overcome the resistance of water. The slag box front plate 213 may be provided with a pull ring, a handle, or the like protruding from its surface or may also be provided with a pull groove recessed down to its surface. The slag box back plate 214 is perpendicular to the slag box bottom plate 211; the slag box bottom plate 211 and/or the slag box back plate 213 are provided with a filter screen, and after the water carrying the debris enters the slag box 21, the hull 1 continues to travel, the water is discharged from the filter screen, and the debris is left within the slag box 21. The width of the slag box front plate 213 and the slag box back plate 214 are the same, i.e., it is the width of the slag box; the width of the front portion and the back portion of the water passage 15 are the same and are slightly larger than the width of the slag box, so that the slag box 21 can enter and exit the water passage 15 by itself. The filter screen is integrally molded with a steel wire and a plastic frame so that the slag box bottom plate 211 is stronger and has a longer service life.

The slag box 21 further includes two slag box slide grooves 215 and two slag box bayonets 216, the two slag box slide grooves 215 are recessed down to the outer side walls of the two slag box side plates 212, respectively; the two slag box bayonets 216 are provided in the upper portion of the back end of the two slag box side plates 212, respectively, the slag box bayonets 216 are preferably right-angled notches so as to allow the slag box 21 to be stably connected to the hull 1 after being inserted into the water passage 15.

As shown in FIGS. 2 to 3, the cleaning device 2 further includes two slag box slide guides 141 and a slag box baffle 111. The two slag box slide guides 141 protrude from the side walls of the two buoyancy tanks on both sides of the water passage 15, respectively, and the side walls of the two buoyancy tanks respectively belong to the two buoyancy tanks 14 and are slidably assembled to the two slag box slide grooves 215. When the slag box 21 is inserted into the water passage 15, the slag box slide guides 141 slide along the slag box slide grooves 215 so that the slag box 21 can be easily and quickly assembled to the bottom of the hull 1 or disassembled from the bottom of the hull 1. The slag box baffle 111 protrudes downward from the bottom of the hull plate 11, and preferably, the slag box baffle 111 is perpendicular to the hull plate 11. When the slag box 21 is assembled to the hull 1, the slag box baffle 111 is snapped into the slag box bayonets 216 so that the slag box 21 remains fixed relative to the hull 1.

Figure 5:
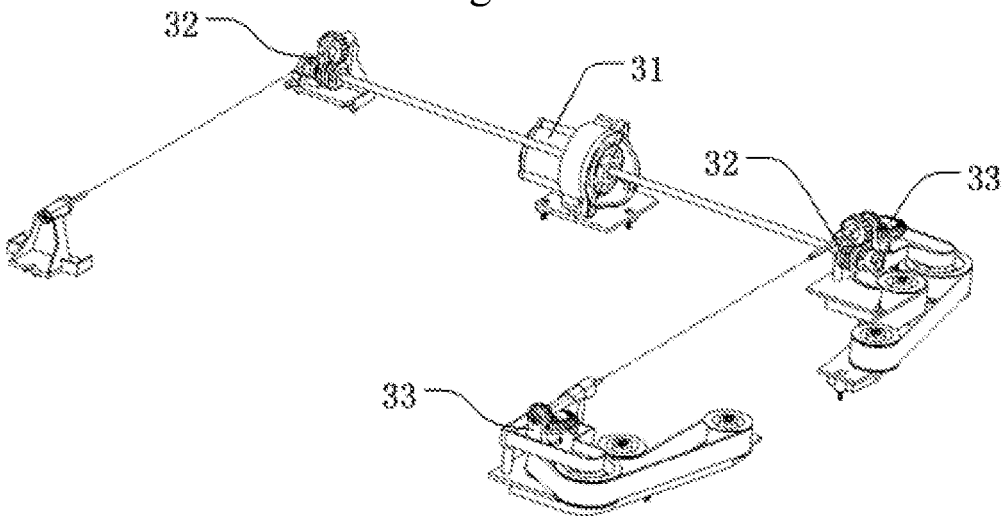
FIG. 5 is a layout schematic view of the power unit and the steering device according to Embodiment 1 of the present invention.
Figure 6:
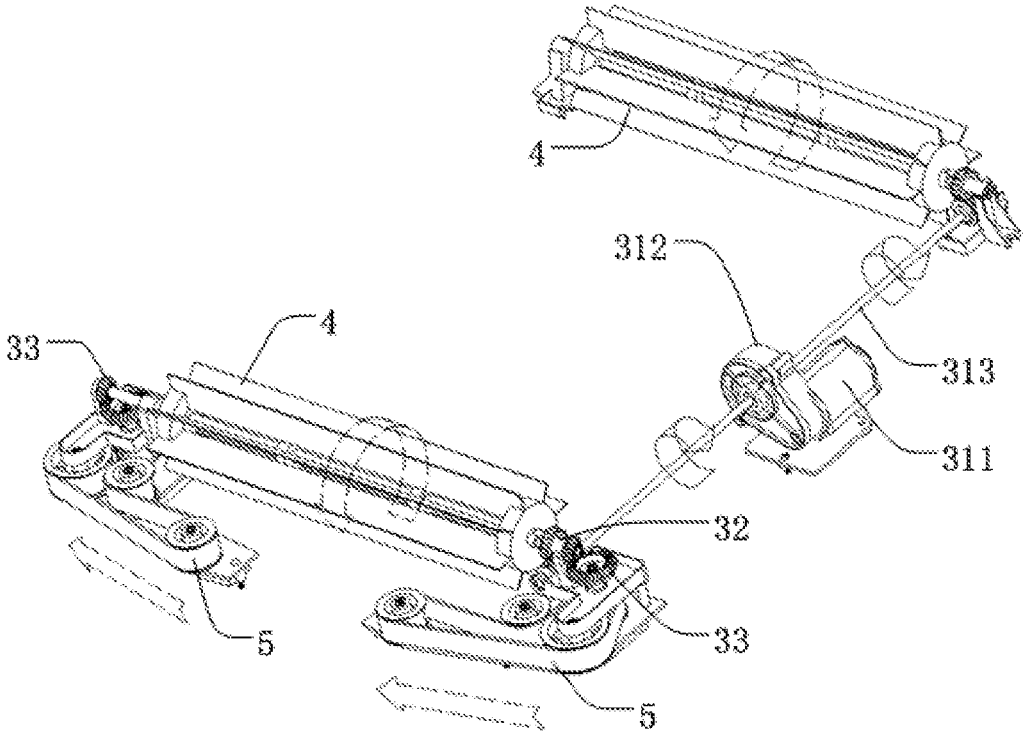
FIG. 6 is a layout schematic view of the power unit, the propulsion device and the steering device according to Embodiment 1 of the present invention.

As shown in FIGS. 5 to 6, the power unit 3 includes a gear motor 31, a first torque transmission mechanism 32, and a second torque transmission mechanism 33. The gear motor 31 is used for outputting a torque; the first torque transmission mechanism 32 is used for transmitting the torque outputted from the gear motor 31 to the propulsion device 4; and the second torque transmission mechanism 33 is used for transmitting the torque outputted from the gear motor 31 to the steering device 5; wherein the steering device 5 and the propulsion device 4 introduce a torque synchronously, and move in synchronism.

The gear motor 31 includes a motor 311, a speed reducer 312, and a power output shaft 313. The power output shaft 313 extends in the forward and backward directions of the hull 1 (the forward and backward directions here refer to the traveling direction of the hull 1), for providing power to the two propulsion devices 4 at the front end and the back end of the hull 1. There is only one gear motor 31, which may be provided on one side of the hull 1, and the gear motor 31 is provided on the left or right side of the hull 1 with reference to the advancing direction of the hull 1, specifically, the gear motor 31 is provided within the assembly space 13, the assembly space 13 is well sealed to prevent water from entering the gear motor 13. In this embodiment, it is preferably provided within the assembly space 13 on the right side of the hull 1, and thus the weight on the right side of the hull 1 is larger than that on the left side. Therefore, the volume of the buoyancy tank 14 on the right side of the hull is larger than that of the buoyancy tank 14 on the left side of the hull, the buoyancy force received by the buoyancy tank 14 on the right side is greater than the buoyancy force received by the buoyancy tank 14 on the left side, thereby ensuring that the center of gravity of the hull 1 is on its center line to ensure the hull's lateral balance.

As shown in FIG. 6, this embodiment includes two propulsion devices 4 at the front end and back end of the hull 1, and also includes two first torque transmission mechanisms 32 at both ends of the power output shaft 313 which are respectively provided at the front end and the back end of the hull 1. Both ends of the power output shaft 313 are connected to one propulsion device 4 via one first torque transmission mechanism 32, respectively. The propulsion devices 4 at the front end and the back end of the hull 1 are operated synchronously in the same direction under the action of the same power output shaft 313. When the power output shaft 313 is rotated in the forward direction, the propulsion devices 4 in the front and back push water backward simultaneously and the hull travels forward; and when the power output shaft 313 is rotated in the reverse direction, the propulsion devices 4 in the front and back push water forward simultaneously and the hull travels backward.

Figure 7:
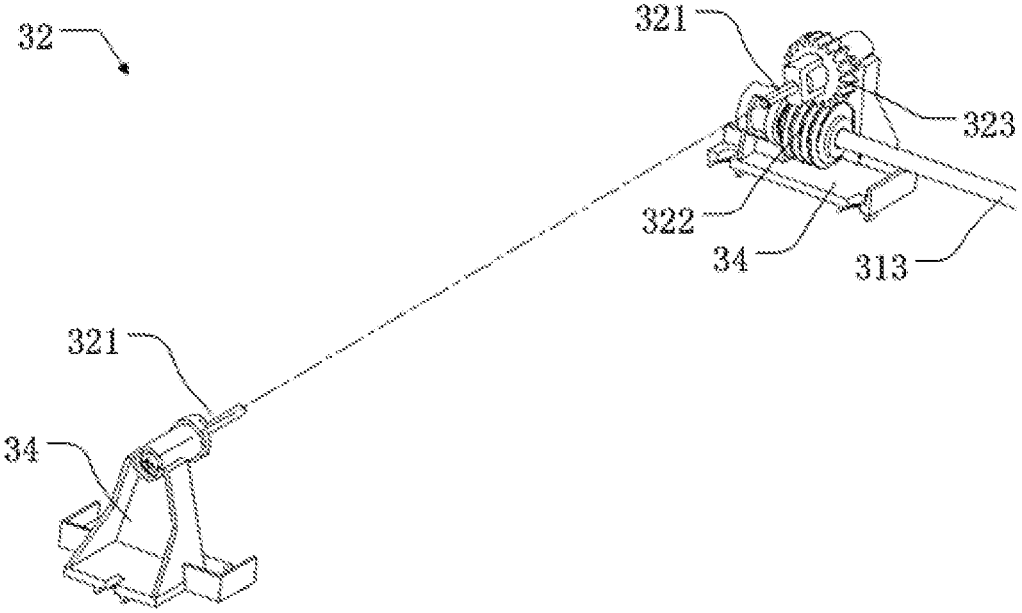
FIG. 7 is a structural schematic view of the first torque transmission mechanism according to Embodiment 1 of the present invention.

As shown in FIG. 7, each of the first torque transmission mechanisms 32 includes two transmission shafts 321, a worm 322, and a worm wheel 323. The two transmission shafts 321 are rotatably assembled to the hull 1 and are respectively connected to both ends of the propeller rotary shaft 41 of the propulsion device 4; the central axis of the transmission shaft 321 is perpendicular to the central axis of the power output shaft 313 in a different surface, the worm 322 is provided on one end of the power output shaft 313; the worm wheel 323 is fixed to one transmission shaft 321 and is drivingly engaged with the worm 322.

When the power output shaft 313 is rotated, the power output shaft 313 drives the two transmission shafts 321 and the propeller rotary shaft 41 to be rotated synchronously under the transmission action of the worm 322 and the worm wheel 323. Since the two first torque transmission mechanisms 32 provided at the front end and the back end of the hull are identical in structure, the four transmission shafts 321 are rotated synchronously under the action of the same power output shaft 313.

This embodiment also includes a transmission shaft bracket 34 provided on the lower surface of the hull plate 1 and perpendicular to the hull plate 1; a transmission shaft mounting hole is provided in the middle of the transmission shaft bracket 34, and the transmission shaft 321 is rotatably assembled into the transmission shaft mounting hole, and preferably, the transmission shaft 321 is assembled into the transmission shaft mounting hole 341 via a bearing. Since four transmission shafts 321 are included in this embodiment, thus accordingly, the number of the transmission shaft brackets 34 is also four, ensuring that the transmission shafts 321 can be rotated freely.

Figure 8:
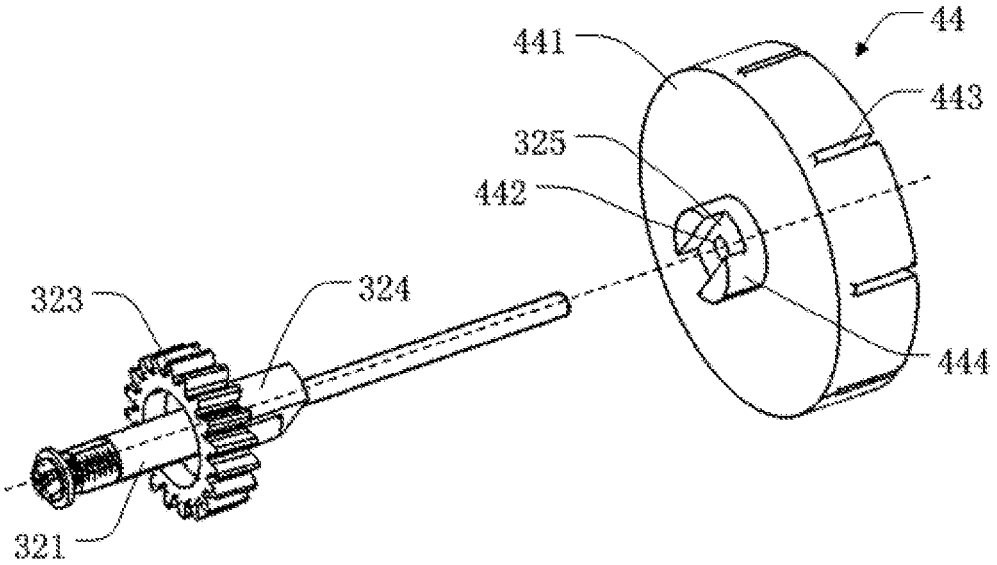
FIG. 8 is a structural schematic view of one rotary shaft end cap and one transmission shaft according to Embodiment 1 of the present invention.

As shown in FIG. 8, the first torque transmission mechanism 32 further includes a torque transmission bump 324 and a torque transmission slide groove 325, and the torque transmission bump 324 is snapped into the torque transmission slide groove 325. One of the torque transmission bump 324 and the torque transmission slide groove 325 protrudes from the surface of one end of one transmission shaft 321 and the other thereof is provided in a end cap connector of the rotary shaft end cap of the propulsion device 4. The torque transmission bump 324 and the torque transmission slide groove 325 cooperate with each other, so that the transmission shaft 321 remains fixed relative to the rotary shaft end cap 44 of the propulsion device 4 to transmit the torque to the propulsion device 4.

This embodiment includes two steering devices 5 provided on the left and right sides of the front end of the hull 1, a first torque transmission mechanism 32 located at the front end of the hull 1, and two transmission shafts 321 at both ends thereof are connected to one steering device 5 via one second torque transmission mechanism 33. The two transmission shafts 321 at the left and right ends of the first torque transmission mechanism 32 are disposed left-right symmetrically on the hull.

Figure 9:
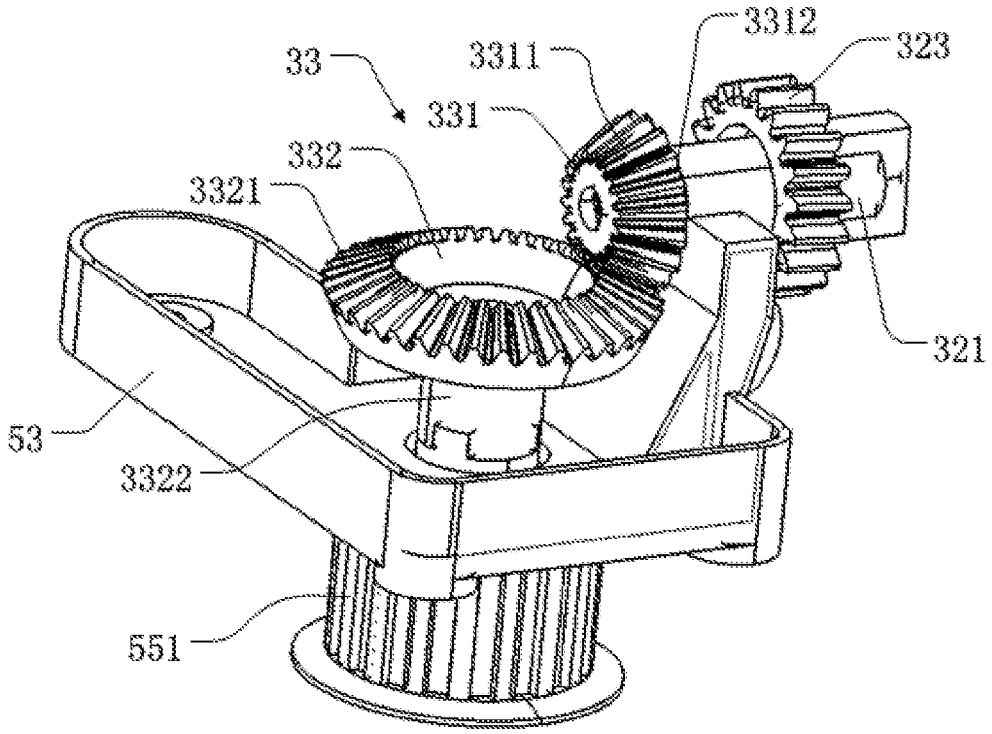
FIG. 9 is a structural schematic view of the second torque transmission mechanism according to Embodiment 1 of the present invention.

As shown in FIG. 9, two second torque transmission mechanisms 33 are included in this embodiment, which are identical in structure, and each of the second torque transmission mechanisms 33 includes a first bevel gear 331 and a second bevel gear 332 which cooperates with each other. The first bevel gear 331 includes first tapered gear teeth 3311 and a first bevel gear shaft 3312 which are integrally provided, and the first bevel gear shaft 3312 is fixedly connected to one transmission shaft 321. The second bevel gear 332 includes second tapered gear teeth 3321 and a second bevel gear shaft 3322 which are integrally provided, and the second tapered gear teeth 3321 are drivingly engaged with the first bevel gear shaft; the second bevel gear shaft 3322 is perpendicular to the first bevel gear shaft 3312 and is connected to a driving wheel 511 of the steering device 5.

When the transmission shaft 321 is rotated, the driving wheel 511 of the steering device 5 is rotated by the second torque transmission mechanism 33 under the action of the first bevel gear 331 and the second bevel gear 332. In this embodiment, the two steering devices 5 are provided on the left and right sides of the front end of the hull 1, respectively, and since the two transmission shafts 321 at the front end of the hull are rotated synchronously, the two second torque transmission mechanisms 33 are identical in structure, the driving wheels 511 of the two steering devices 5 are also rotated synchronously.

In this embodiment, the power unit 3 simultaneously provides the torque for the propulsion device 4 and the steering device 5 so that the two propulsion devices 4 provided at the front and back of the hull and the two steering devices 5 provided on the left and right sides of the front end of the hull can be rotated synchronously.

Similarly, this embodiment may also include four steering devices 5 and four second torque transmission mechanisms 33, the four steering devices 5 are provided on the left and right sides at the front end and the back end of the hull 1, respectively. Each of the first torque transmission mechanisms 32 is provided with a transmission shaft 321 at both ends thereof, and the four transmission shafts 321 are connected to one steering device 5 via one second torque transmission mechanism 33, respectively.

Figure 10:
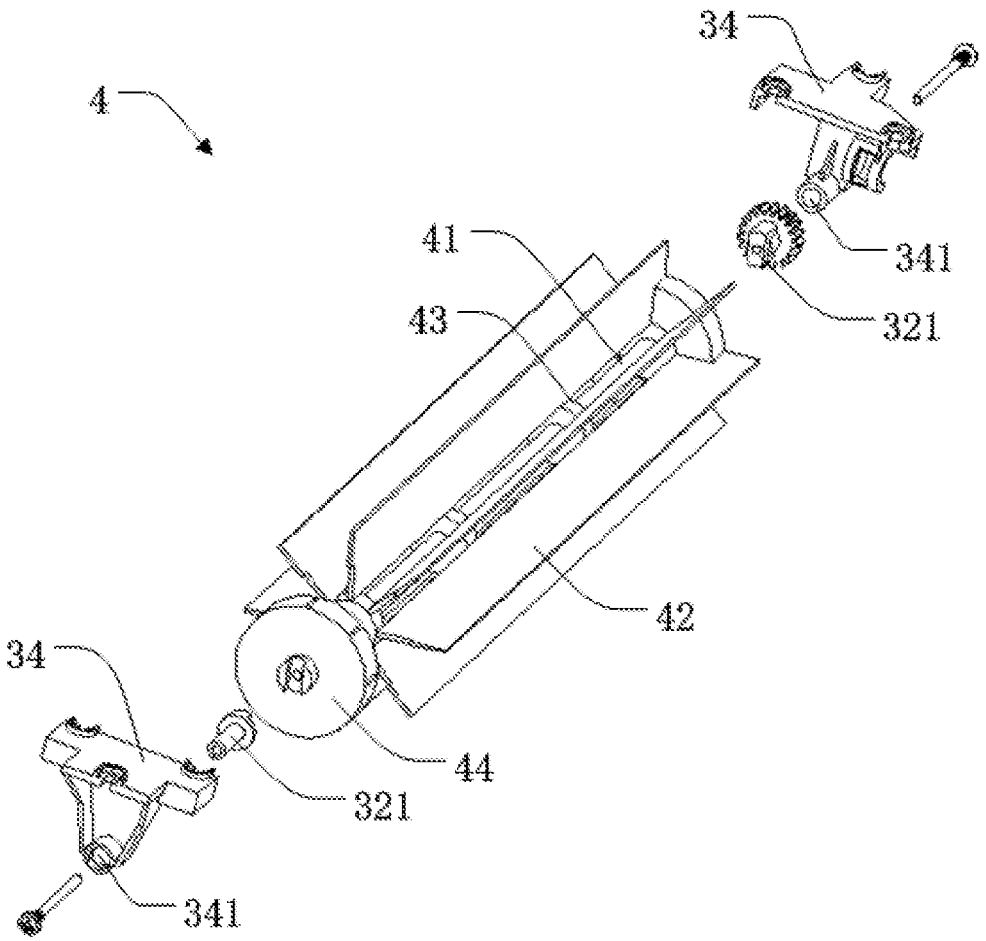
FIG. 10 is an exploded structural schematic view of the propulsion device according to Embodiment 1 of the present invention.

As shown in FIGS. 6 and 10, preferably, this embodiment includes two propulsion devices 4 respectively provided at the front end and the back end of the hull 1 to propel the hull 1 to travel on the water surface. Each of the propulsion devices 4 includes a propeller rotary shaft 41 and at least one vane 42, preferably eight vanes 42. This embodiment may also include only one propulsion device 4 provided at the front end or the back end of the hull 1.

The propeller rotary shaft 41 is rotatably assembled to the bottom of the hull 1; and the propeller rotary shaft 41 is connected to the gear motor via the first torque transmission mechanism 32 to acquire a torque. Specifically, both ends of the propeller rotary shaft 41 are connected to one transmission shaft 321, respectively, and the center axes of the two transmission shafts 321 are on the same straight line as the central axis of the propeller rotary shaft 41.

The propeller rotary shaft 41 is a telescopic rotary shaft having a variable length so as to perform a shock-absorbing function during traveling of the hull, so that the propeller rotary shaft 41 can be rotated smoothly and freely under the action of the first torque transmission mechanism 32. To achieve this effect, this embodiment provides the following two technical solutions.

Figure 11:
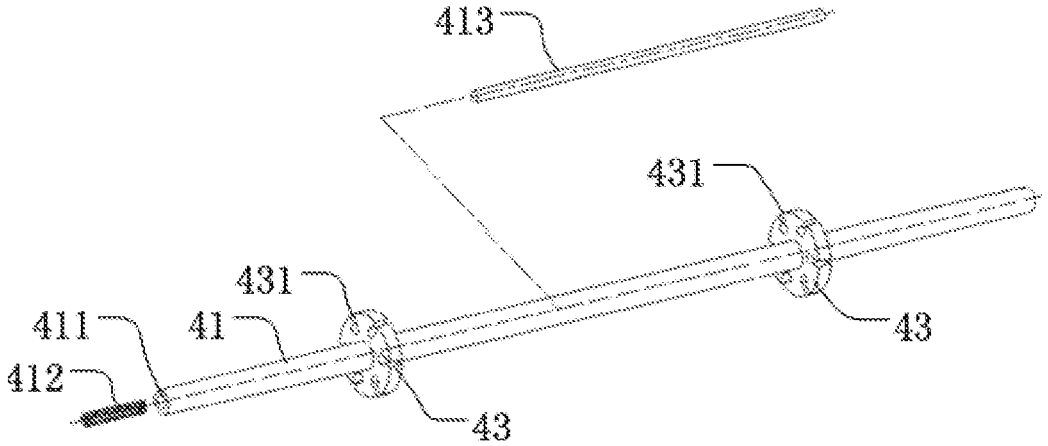
FIG. 11 is an exploded structural schematic view of a propeller rotary shaft according to Embodiment 1 of the present invention.

As shown in FIG. 11, the propeller rotary shaft 41 is a hollow shaft in which a rotary shaft through hole 411 is formed. One end of the rotary shaft through hole 411 is sealed, and the other end thereof is provided in turn with a first elastic member 412 and a first telescopic shaft 413 from outside to inside. One transmission shaft 321 in the first torque transmission mechanism 32 passes through the end cap through hole 442 of one rotary shaft end cap 44 and is inserted into the rotary shaft through hole 411 and is connected to the first elastic member 412. In this embodiment, the first elastic member 412 is preferably a helical compression spring.

Figure 12:
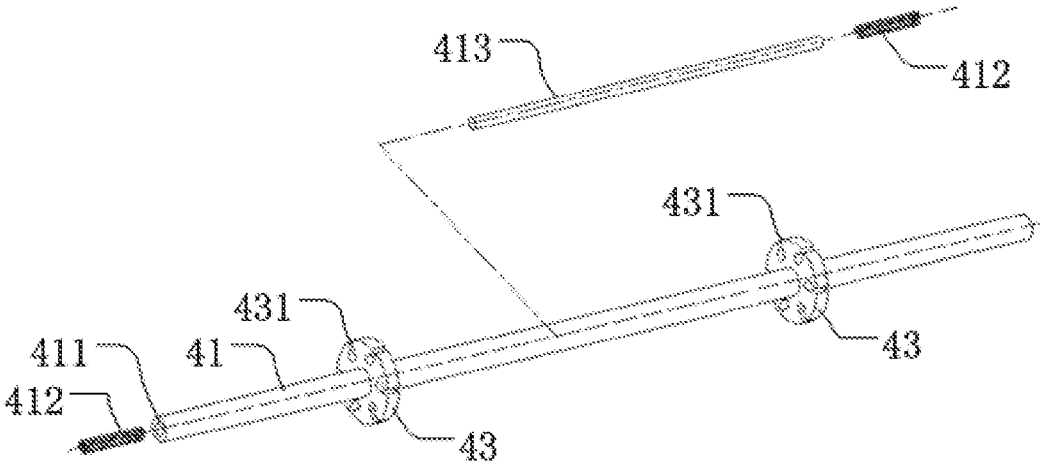
FIG. 12 is an exploded structural schematic view of another propeller rotary shaft according to Embodiment 1 of the present invention.

As shown in FIG. 12, two first elastic members 412 and one first telescopic shaft 413 can also be provided within the rotary shaft through hole 411, the first telescopic shaft 413 is located at the middle of the rotary shaft through hole 411, and the two first elastic members 412 are connected to both ends of the first telescopic shaft 413, respectively. The two transmission shafts 321 in the first torque transmission mechanism 32 respectively pass through the end cap through hole 442 of one rotary shaft end cap 44, are inserted into the rotary shaft through hole 411 from both ends of the propeller rotary shaft 41, and are respectively connected to one first elastic member 412.

The propulsion device 4 also includes a vane socket 43 fixed to the propeller rotary shaft 41, and preferably, is disposed integrally with the propeller rotary shaft 41 and is provided on the outer surface of the propeller rotary shaft 41; the vane socket 43 is provided with at least one vane mounting position 431, preferably eight, each of the vane mounting positions 431 is assembled with a vane 42. The vane 42 is a planar vane which is distributed radially and evenly and fixed to the side wall of the propeller rotary shaft 41. When the propeller rotary shaft 41 is rotated, the vane 42 pushes water backward to propel the hull 1 to move forward.

As shown in FIG. 8, the propulsion device 4 further includes two rotary shaft end caps 44 fixed to both ends of the propeller rotary shaft 41. The rotary shaft end cap 44 includes an end cap body 441, an end cap through hole 442, at least one end cap bayonet 443, and an end cap connector 444. The end cap body 441 is formed in a cap shape and includes an integrated circular flat plate and an annular side wall protruding from the circular flat plate. The end cap through hole 442 is provided at the center of the end cap body 441 and extends through the center of the circular flat plate. A plurality of end cap bayonets 443 (preferably eight in this embodiment) are provided at the edge of the end cap body 441 (i.e., the annular side wall), and a vane 42 is snapped within each of the end cap bayonets 443. The end cap connector 444 is provided on the side of the end cap body 441 remote from the propeller rotary shaft and protrudes from the surface of the circular flat plate for connecting the transmission shaft 321.

The vane mounting position 44 of the propeller rotary shaft 41 and the end cap bayonets 443 of the rotary shaft end cap 44 together fix multiple vanes 42 with the propeller rotary shaft 41 and the rotary shaft end cap 44 in a whole to form a planar impeller. When the hull 1 floats on the water surface, the lower half of the propulsion device 4 is below the water surface. When the gear motor 31 is operated, the transmission shaft 321 acquires the torque from the power output shaft 313 to drive the propeller rotary shaft 41 to be rotated, and the vane 42 pushes water backward thereby propelling the hull 1 to travel.

In this embodiment, the two propulsion devices 4 are provided at the front end and the back end of the hull 1, and introduce a torque outputted from the gear motor 31 synchronously via the first torque transmission mechanism 32, and then are rotated in synchronism, pushes water backward or forward simultaneously, so that the hull 1 travels forward or backward.

As shown in FIG. 6, the steering device 5 is provided at the left front end and/or the right front end of the hull 1, and specifically, is provided at the corner portion between the front end of the hull 1 and the left side edge and/or right side edge thereof.

Figure 13:
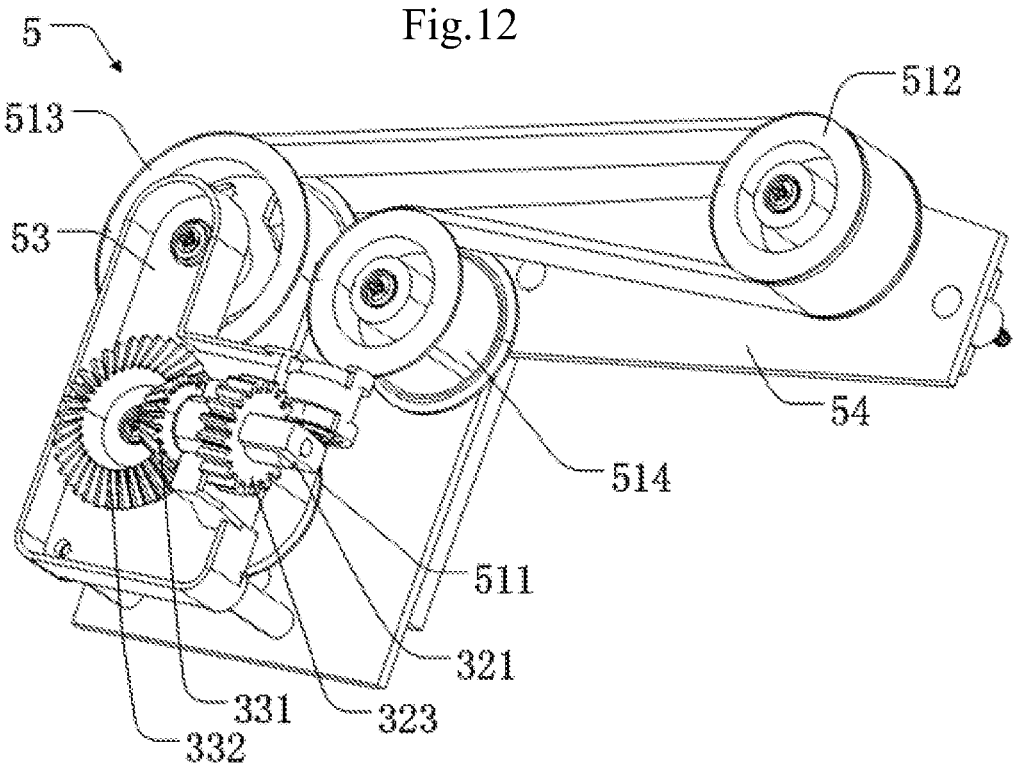
FIG. 13 is a structural schematic view of the steering device on the right front end according to Embodiment 1 of the present invention.
Figure 14:
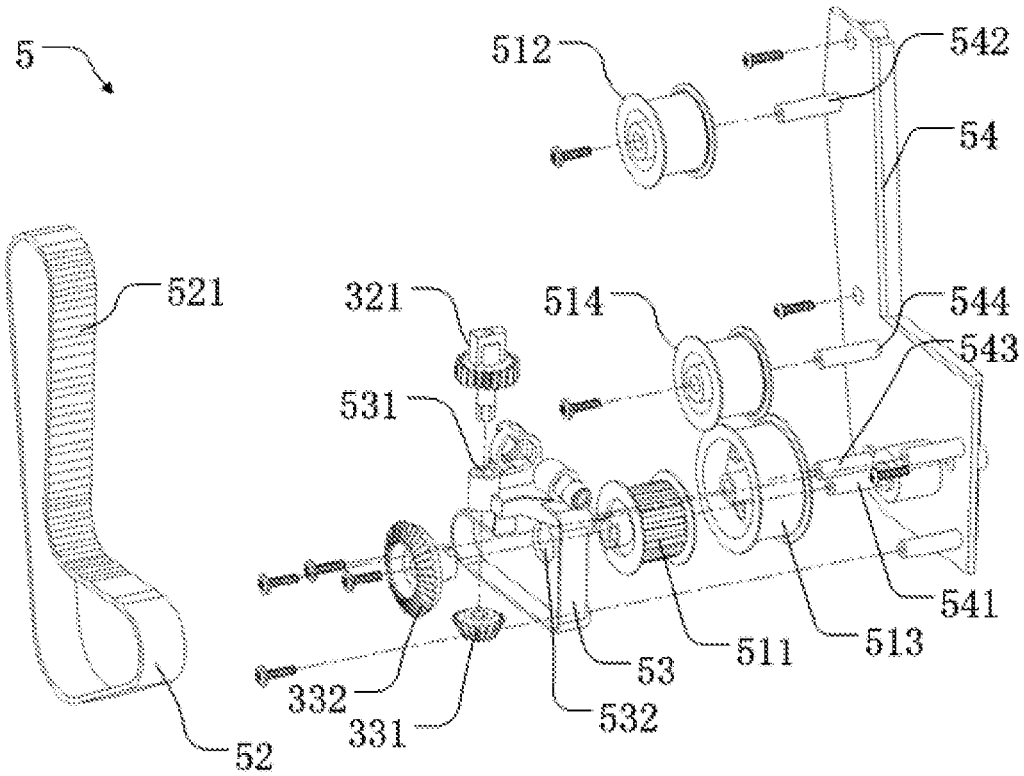
FIG. 14 is an exploded structural schematic view of the steering device on the right front end according to Embodiment 1 of the present invention.
Figure 15:
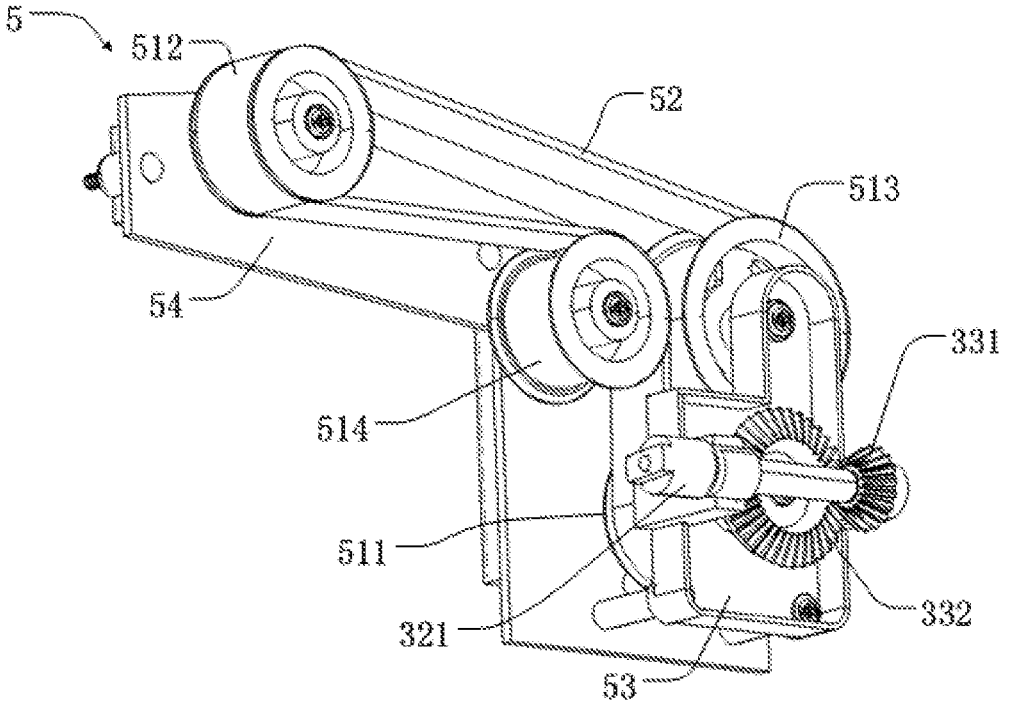
FIG. 15 is a structural schematic view of the steering device on the left front end according to Embodiment 1 of the present invention.

As shown in FIGS. 13 to 15, the steering device 5 includes a transmission wheel set 51 and an endless track 52.

In this embodiment, two transmission wheel sets 51 are preferred, which are provided on the left and right sides of the front end of the hull 1, respectively, and when the corner portion on either side of the front end of the hull 1 comes into contact with an obstacle, the hull 1 can be rotated relative to the obstacle. This embodiment may also include only one transmission wheel set 51 provided on the left side or the right side of the front end of the hull 1, and only when the corner portion on the side where the steering device is provided in the hull 1 comes into contact with an obstacle, the hull 1 can be rotated relative to the obstacle.

Each of the transmission wheel sets 51 includes a driving wheel 511, a front bogie wheel 512, and a corner bogie wheel 513. The driving wheel 511 is connected to the transmission shaft 321 via the second torque transmission mechanism 33 to acquire a torque; the front bogie wheel 512 is provided at the foremost end of the hull 1; the corner bogie wheel 513 is provided at the leftmost or rightmost end of the front portion of the hull 1. The driving wheel 511, the front bogie wheel 512, and the corner bogie wheel 513 are all wheeled structures and all include an annular outer side wall, referred to as a wheel wall.

Wherein the front bogie wheel 512 is provided between the middle point of the front end of the hull 1 and the corner bogie wheel 513, and the distance between the front bogie wheel 512 and the corner bogie wheel 513 is greater than the distance between the front bogie wheel 512 and the middle point of the front end of the hull 1, so that the front bogie wheel 512 is closer to the middle point of the front end of the hull 1. The two transmission wheel sets 51 provided on the left and right sides of the front end of the hull 1 are respectively provided with one front bogie wheel 512, the side walls of the hull between the two front bogie wheels 512 are recessed inwardly to form a concave surface, ensuring that the two front bogie wheels 512 may be located at the foremost end of the hull 1.

The steering device 5 includes a bevel gear mounting frame 53 for mounting the second torque transmission mechanism 33, the bevel gear mounting frame 53 is disposed opposite to a portion of the endless track 52 and is fixed to the wheel set mounting plate 54 and then is fixedly connected to the hull 1. The bevel gear mounting frame 53 includes a first bevel gear mounting hole 531 and a second bevel gear mounting hole 532, the central axis of the first bevel gear mounting hole 531 is perpendicular to the central axis of the second bevel gear mounting hole 532, and a first bevel gear 331 is rotatably assembled within the first bevel gear mounting hole 531; and a second bevel gear 332 is rotatably assembled within the second bevel gear mounting hole 532.

In this embodiment, the gear motor 31 of the power unit 3 is operated and the power output shaft 313 outputs a torque; the transmission shaft 321 of the first torque transmission mechanism 32 acquires the torque from the power output shaft 313 and is rotated. When the transmission shaft 321 is rotated, the driving wheel 511 is driven to be rotated by the first bevel gear 331 and the second bevel gear 332. In this embodiment, the two steering devices 5 are provided on the left and right sides of the front end of the hull 1, respectively, and since the two transmission shafts 321 at the front end of the hull are rotated synchronously, the two second torque transmission mechanisms 33 are identical in structure, the driving wheels 511 of the two steering devices 5 are also rotated synchronously in the same direction.

The steering device 5 includes a wheel set mounting plate 54 which is disposed opposite to the endless track 52 and is fixedly connected to the hull 1; and the driving wheel 511, the front bogie wheel 512, and the corner bogie wheel 513 are rotatably assembled to the wheel set mounting plate 54. The bevel gear mounting frame 53 and the wheel set mounting plate 54 are provided on both sides of the endless track 52, respectively; in this embodiment, the wheel set mounting plate 54 is provided above the endless track 52 or is provided below the endless track 52.

Specifically, the steering device 5 includes a driving wheel mounting shaft 541, a front bogie wheel mounting shaft 542, and a corner bogie wheel mounting shaft 543, all of which protrude below from the wheel set mounting plate 54 and are vertically fixed to the wheel set mounting plate 54, wherein the driving wheel 511 is rotatably disposed around the outside of the driving wheel mounting shaft 541, the front bogie wheel 512 is rotatably disposed around the outside of the front bogie wheel mounting shaft 542, and the corner bogie wheel 513 is rotatably disposed around the outside of the corner bogie wheel mounting shaft 543, so that the driving wheel 511, the front bogie wheels 512 and the corner bogie wheels 513 below the wheel set mounting plate 54 can be rotated freely.

The endless track 52 defines an irregularly shaped track inner space. The endless track 52 is provided inside the track inner space around the transmission wheel set 51, the driving wheel 511, the front bogie wheel 512, and the corner bogie wheel 513. The driving wheel 511, the front bogie wheel 512, and the corner bogie wheel 513 are at the same height, the width of the wheel walls thereof are the same and are slightly larger than the width of the endless track 52, and the endless track 52 is made of a material having a certain elasticity (such as rubber) and is in a tensioned state such that a portion of the wheel walls of the driving wheel 511, the front bogie wheel 512 and the corner bogie wheel 513 is tangent to the inner surface of the endless track 52, so that the front bogie wheel 512 and the corner bogie wheel 513 can be driven to be rotated by the driving wheel 511, so that the endless track 52 can be driven to be transmitted by the driving wheel 511.

When the driving wheel 511 is rotated, since the endless track 52 is in the tensioned state, the endless track 52 can be driven by the driving wheel 511 to be rotated with the driving wheel 511 synchronously. Since the driving wheels 511 of the two steering devices 5 are rotated synchronously in the same direction, the endless tracks 52 of the two steering devices 5 are also transmitted synchronously in the same direction.

The inner surface of the endless track 52 is provided with engaging teeth (not shown); the driving wheel 512 is a toothed pulley; the endless track 52 is drivingly engaged with the toothed pulley via the engaging teeth. Similarly, the front bogie wheel 512 and the corner bogie wheel 513 may also be toothed pulleys, which are drivingly engaged with the endless track 52 via the engaging teeth. Alternatively, the outer sides of the front bogie wheel 512 and the corner bogie wheel 513 may be rough surfaces with increased friction coefficient thereof, and the rough surfaces may be provided with particles, patterns or racks, etc. When the driving wheel 511 is rotated, since the endless track 52 is in the tensioned state and is coated outside the rotatable front bogie wheel 512 and corner bogie wheel 513, the front bogie wheel 512 and the corner bogie wheel 513 are rotated in synchronism with the driving wheel 511 under the action of the endless track 52.

In this embodiment, if the transmission wheel set 51 only includes the driving wheel 511, the front bogie wheel 512, and the corner bogie wheel 513, the shape of the track inner space defined by the endless track 52 is approximately triangular, occupying a larger space within the hull 1, which will affect the layout of other components within the hull. Therefore, a locating bogie wheel 514 is provided outside the track inner space, which is rotatably assembled to the wheel set mounting plate 54 for defining the position of the endless track 52. Specifically, this embodiment further includes a locating bogie wheel mounting shaft 544 protruding from below the wheel set mounting plate 54 and perpendicularly fixed to the wheel set mounting plate 54, the locating bogie wheel 514 is rotatably disposed around the outside of the locating bogie wheel mounting shaft 544, so that the locating bogie wheel 514 below the wheel set mounting plate 54 can be rotated freely. The driving wheels 511, the front bogie wheels 512, the corner bogie wheels 513, and the locating bogie wheel 514 are at the same height, and the width of the respective wheel walls thereof are the same and are slightly larger than the width of the endless track 52. The wheel wall of the outer surface of the locating bogie wheel 514 is tangent to the outer surface of the endless track 52 to define the position of the endless track 52 and to reduce the coverage area of the track inner space, so that the shape of the track inner space is approximately L-shaped.

The outer surface of the endless track 52 and the outer surface of the bogie wheel 514 may be rough surfaces which may be provided with particles, patterns, etc. In this embodiment, racks 521 are preferable for increasing the friction coefficient between the wheel wall of the bogie wheel 514 and the outer side wall of the endless track 52, so that the bogie wheel 514 can be rotated under the action of the endless track 52 without affecting the normal transmission of the endless track 52.

A segment of the endless track 52 is used for contacting an obstacle on the water surface, which may be referred to as a track contact portion. The track contact portion is positioned at one corner portion by the transmission wheel set 51, and specifically, is positioned at the corner portion between the front end of the hull 1 and the left side edge and/or the right side edge thereof by the front bogie wheel 512 and the corner bogie wheel 513. The segment of the endless track 52 protrudes from the front end or the side edge of the hull 1 and is exposed outside the hull 1, and specifically, an opening is provided at the connection (corner portion) between the front wall and the right and left side edges of the hull 1, the track contact portion 521 extends beyond the hull 1 from the opening.

The track contact portion includes a front contact portion, a corner contact portion, and a middle section contact portion, wherein the front contact portion is a portion of the track which is coated outside the front bogie wheel 512, the corner contact portion is a portion of the track which is coated outside the corner bogie wheel 513, and the middle section contact portion is a portion of the track which is provided between the front bogie wheel 512 and the corner bogie wheel 513. Since the front bogie wheel 512 is provided at the foremost end of the hull 1 and the corner bogie wheel 513 is provided at the leftmost or rightmost end of the front portion of the hull 1, the track contact portion is coated at the foremost, leftmost or rightmost end of the hull 1. When the hull travels forward, if there is an obstacle in the traveling path on the water surface, one or both of the track contact portions 521 at the front end of the hull 1 come into contact with the obstacle firstly.

The width of the endless track 52 can be self-adjusted according to the actual needs and the endless track 52 makes surface contact with the obstacle; compared with the prior art rollers, the contact area is larger, the frictional force is greater, and the occurrence of skidding is prevented in this embodiment. The outer surface of the endless track 52 is a rough surface which is provided with particles, patterns or racks, etc., for increasing the friction coefficient of the outer surface of the endless track 52, so that the endless track 52 can be better transmitted on the surface of the obstacle and the occurrence of skidding is prevented, so that the hull 1 and the obstacle are relatively rotated to adjust the traveling direction of the hull 1. The hull 1 travels in a new direction under the action of the propulsion devices 4 in the front and back when the hull 1 is completely separated from the obstacle.

As shown in FIG. 6, this embodiment includes two steering devices 5 on the left and right, and since the driving wheels 511 of the two steering devices 5 turn in the same direction, the rotation directions of the endless tracks 52 of the two steering devices 5 are the same. When both of the endless tracks 52 contact the surface of the obstacle, the two endless tracks 52 and the obstacle are relatively rotated in the same direction, and the directions of the acting forces applied on the hull 1 via the two endless tracks by the obstacle are the same, so that the hull 1 deviates from the obstacle and the hull 1 turns.

In the power unit 3, the power output shaft 313 of the gear motor 31 may be a bidirectional rotation shaft, that is, can be rotated in reverse directions. When the power output shaft 313 is rotated in the reverse direction, the propeller rotary shaft 41 of the propulsion device 4 is rotated in the reverse direction, the vane 42 is rotated forward, and the hull 1 travels backward.

As shown in FIGS. 1 to 3, the control device 6 is provided inside the hull 1 to plan the traveling path of the hull 1 and to control the hull 1 to travel along the planned path to try to achieve debris cleaning within the entire water area within the shortest possible time. The upper surface of the hull 1 is provided with a switch 61 for controlling the start and stop of the power unit 3; and also includes a circuit board 62 provided with a control circuit.

The power supply device 7 includes a rechargeable battery 71 and solar panels 72. The rechargeable battery 71 is a lithium battery which can be repeatedly charged and discharged; two solar panels 72 are provided on the upper surface of the hull 1 and are disposed symmetrically; a photoelectric conversion module is also provided on the circuit board 62.

The anti-skid device 8 is made of an elastic material to prevent the hull 1 from being damaged by the collision of the obstacle with the hull 1 during traveling backward of the hull 1. The anti-skid device 8 is attached to the back end and the left and/or right side wall of the hull 1; the outer surface of the anti-skid device 8 is provided with a rough surface which is provided with particles, patterns or racks, etc., for increasing the friction coefficient of the outer surface of the anti-skid device 8.

During traveling backward of the hull 1, if the hull 1 contacts the obstacle on the water surface, the anti-skid device 8 rests against the obstacle to form a rotating fulcrum, so that the traveling direction of the hull 1 is changed under the action of the propulsion device 4 and the steering device 5.

Taking the process of cleaning the swimming pool with a water surface cleaning machine as example, the main obstacles are the pool wall of the swimming pool and the handrail on the pool side, etc. The hull 1 is retreated along the pool wall, the anti-skid device 8 is urged against the pool wall, and the pool wall applies a resistance to the hull 1 to form a rotating fulcrum, so that the hull 1 is rotated by an angle and then forwardly performs a sweeping task under the action of the propulsion device 4 and the steering device 5, the hull 1 is brought to travel to the central area of the swimming pool from time to time, and performs a full area cleaning of the entire swimming pool. Whether the hull 1 travels forward or backward, the water surface cleaning machine will not be snapped at the pool wall or corner so as to be immovable when the hull 1 encounters something.

The beneficial effect of this embodiment is that a water surface cleaning machine is provided, which can be operated freely on the water surface and complete a certain range of water area cleaning during traveling, and can bypass the obstacle on the water surface during traveling, so that the obstacle will not affect the normal operation of the water surface cleaning machine. This embodiment can turn by itself to bypass the obstacles on the water surface during traveling, thereby avoiding skidding, failing to turn, and failing to move. This embodiment uses only a set of motors to provide power to the propulsion device 4 and the steering device 5, which can reduce the production cost, reduce the overall weight, and effectively reduce the energy consumption.

Embodiment 2

Embodiment 2 includes most of the technical solutions in Embodiment 1, and also includes the following distinguishing technical features.

In Embodiment 1, the water inlet of the slag box 21 is always kept open, and the debris within the slag box 21 floats out of the water inlet when the hull 1 is retreated.

Figure 16:
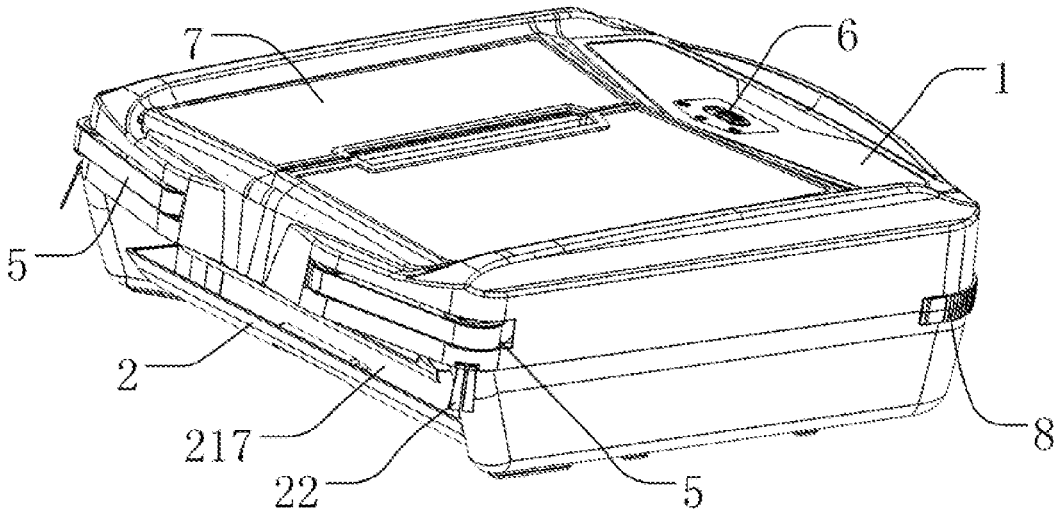
FIG. 16 is an overall structural schematic view of Embodiment 2 of the present invention.
Figure 17:
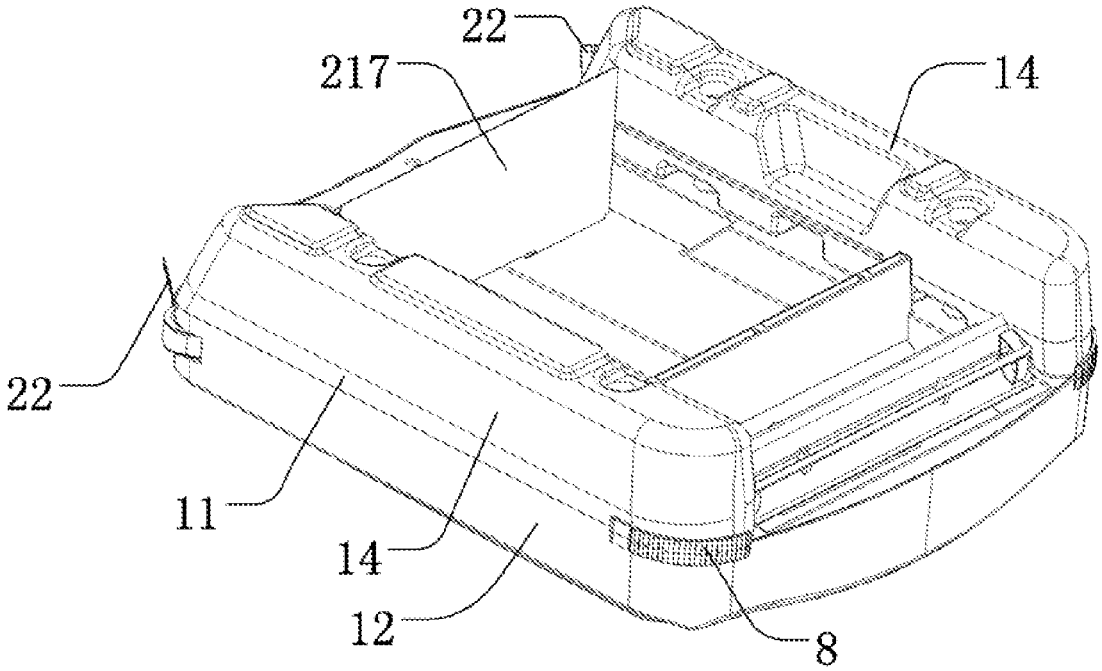
FIG. 17 is a structural schematic view of the bottom surface in Embodiment 2 of the present invention with the slag box removed.

As shown in FIGS. 16 to 17, a distinguishing technical feature between Embodiment 2 and Embodiment 1 is that the cleaning device 2 includes a non-return sheet 217 provided at the water inlet of the water passage 15 and extending across the water passage 15; the upper end of the non-return sheet 217 is rotatably assembled to the bottom of the hull 1 and the lower end thereof is rotatable forward and backward. When water flows into the water passage 15, the water stream brings the debris floating on the water surface into the slag box 21, and the non-return sheet 217 can be rotated, and the non-return sheet 217 remains perpendicular to the slag box bottom plate 215 for most of the time. When the hull 1 is retreated, the non-return sheet 217 can prevent the debris within the slag box 21 from floating out of the water inlet.

Another distinguishing technical feature between Embodiment 2 and Embodiment 1 is that the cleaning device 2 includes a gathering sweeping member 22 protruding from the corner portion between the front end and the side edge of the hull 1. When the hull 1 advances along the pool wall, the gathering sweeping member will push and gather the debris at the pool wall forward, and the debris is gathered into the water passage 15 by the propulsion device 4 at the front end and stored within the slag box 21, and thus realizing the cleaning of the debris at the pool wall.

Figure 18:
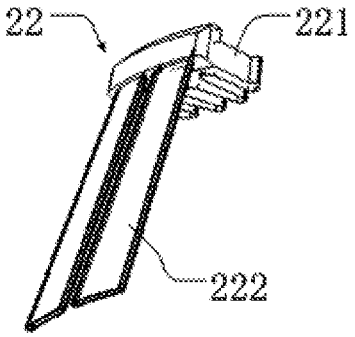
FIG. 18 is a structural schematic view of the hairbrush according to Embodiment 2 of the present invention.

As shown in FIG. 18, the gathering sweeping member 22 is preferably a hairbrush, which includes a brush holder 221 and bristles 222. The brush holder 221 is detachably assembled to the hull 1, and the gathering sweeping member can be replaced after it is damaged. The bristles 222 are fixed to one side of the brush holder 221 and extend in the front-down direction of the hull 1 so as to be able to contact the pool wall to clean the debris. The gathering sweeping member 22 may also be other articles which is made of a material that is easy to deform and restore the shape and may replace the hairbrush, the material includes a sponge, EVA material or gauze, and the like. The gathering sweeping member 22 can swipe the debris which is adsorbed on the side wall of the water pool or is not sucked around the hull 1 so as to be sucked into the slag box 21.

The steering device 5 is located at the corner portion between the front end and the side edge of the hull 1, and the gathering sweeping member 22 is also located at the corner portion, and the height of the gathering sweeping member 22 is lower than that of the steering device 5. When the water surface cleaning machine according to this embodiment is operated, the steering device 5 is located above the water surface, and the gathering sweeping member (such as a hairbrush, etc.) is brought into the water to clean the debris.

Figure 19:
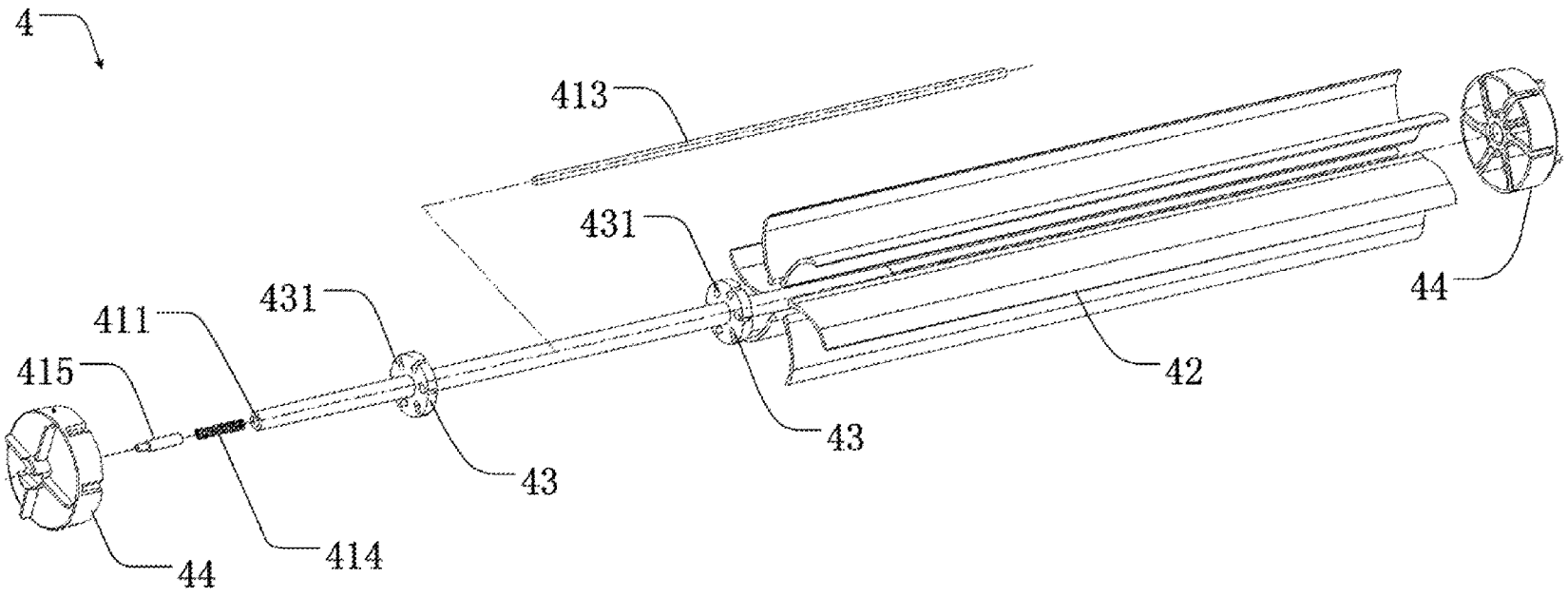
FIG. 19 is an exploded structural schematic view of the propulsion device according to Embodiment 2 of the present invention.

As shown in FIG. 19, another distinguishing technical feature between Embodiment 2 and Embodiment 1 is that the propulsion device 4 is a curved impeller, each of the vanes 42 is curved and has a cross section of an arc; and the bending direction of the vanes 32 coincides with the rotation direction of the propeller rotary shaft 41 when the hull 1 travels forward. The vane mounting position 44 of the propeller rotary shaft 41 and the end cap bayonet 443 of the rotary shaft end cap 44 together fix a plurality of vanes 42 with the propeller rotary shaft 41 and the rotary shaft end cap 44 in a whole to form a curved impeller.

During traveling forward of the hull 1, the curved vane 42 is subjected to a small resistance and has a large displacement. The water surface cleaning machine provided with a curved impeller has a higher kinetic energy conversion efficiency than the water surface cleaning machine provided with a planar impeller.

Another distinguishing technical feature between Embodiment 2 and Embodiment 1 is that the propeller rotary shaft 41 includes a rotary shaft through hole 411, a first telescopic shaft 413, a second elastic member 414, and a second telescopic shaft 415.

The rotary shaft through hole 411 extends from one end through another end of the propeller rotary shaft 41; a first telescopic shaft 413 is provided in the middle of the rotary shaft through hole 411; and a second elastic member 414 is provided within the rotary shaft through hole 411 and is connected to one end of the first telescopic shaft 413; the second telescopic shaft 415 is partially provided within the rotary shaft through hole 411 and has one end connected to the second elastic member 415 and the other end extending beyond the rotary shaft through hole 411 and passes through the end cap through hole 442 of the rotary shaft end cap 4 to be connected to one transmission shaft 321. In this embodiment, the first elastic member 412 is preferably a helical compression spring so that the propeller rotary shaft 41 is a telescopic rotary shaft which can perform a shock-absorbing function during traveling of the hull, so that the propeller rotary shaft 41 can be rotated smoothly and freely under the action of the first torque transmission mechanism 32.

The other technical features of Embodiment 2 are the same as those of Embodiment 1 and will not be described again here.

The beneficial effect of this embodiment is that a water surface cleaning machine is provided, which can be operated freely on the water surface and complete a certain range of water area cleaning during traveling; this embodiment can turn by itself to bypass the obstacles on the water surface during traveling, thereby avoiding skidding, failing to turn, and failing to move; in this embodiment, a non-return sheet is provided, which can effectively prevent the debris within the slag box from slipping out of the water inlet thereof, and a gathering sweeping member is provided, which can push and gather the debris forward to make it easy to enter the slag box, thereby improving the cleaning effect.

Embodiment 3

Embodiment 3 includes most of the technical solutions of Embodiment 2, and also includes the following distinguishing technical features.

In Embodiment 2, the non-return sheet 217 relies on the gravity of the non-return sheet 217 itself so that the non-return sheet 217 is perpendicular to the slag box bottom plate 211 and blocks the debris within the slag box 21. Since the rotation range at the lower end of the non-return sheet 217 is large and the hull 1 is caused to sway during traveling, thus, there still will be some debris floating out of the water inlet of the slag box to when the hull 1 is retreated.

Figure 20:
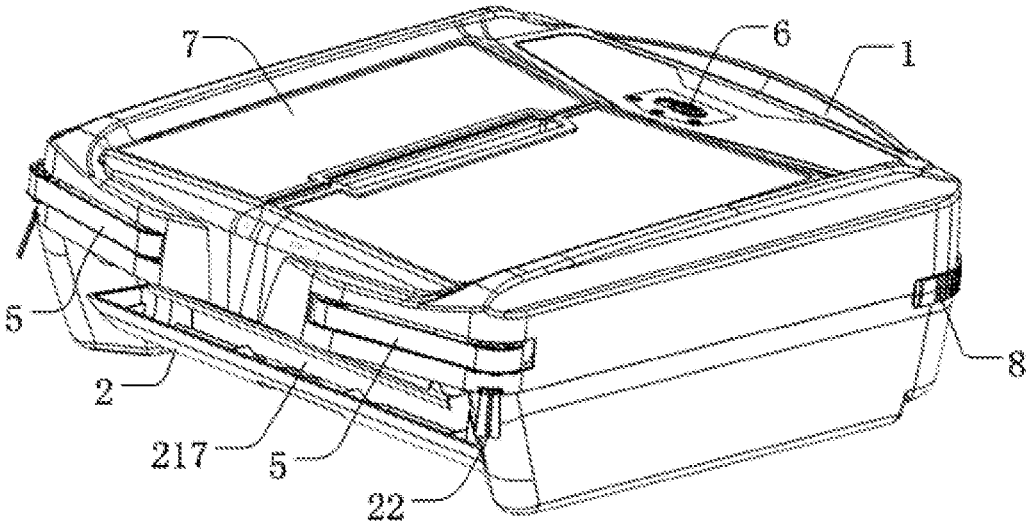
FIG. 20 is an overall structural schematic view of Embodiment 3 of the present invention.
Figure 21:
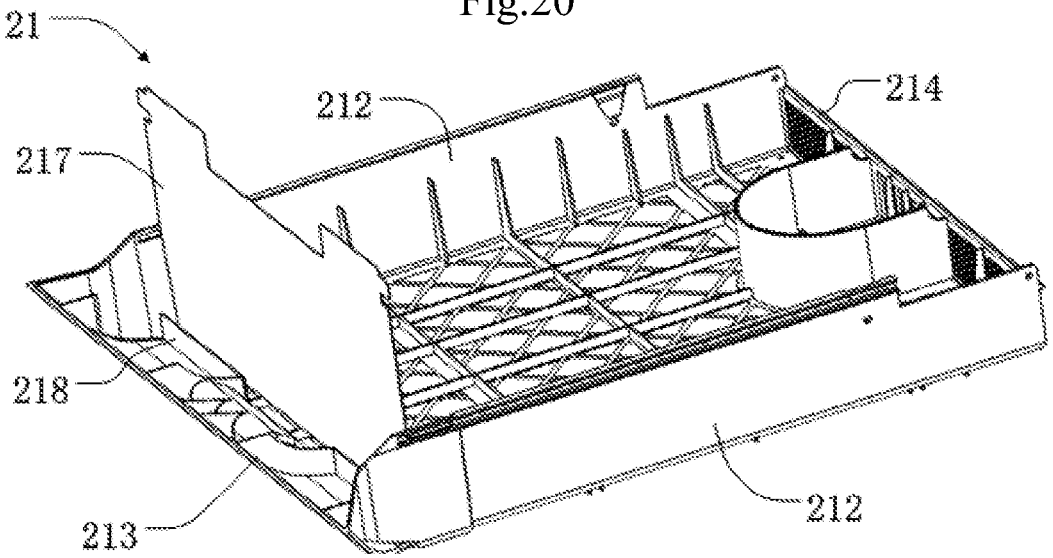
FIG. 21 is a structural schematic view of the slag box and the non-return sheet according to Embodiment 3 of the present invention.
Figure 22:
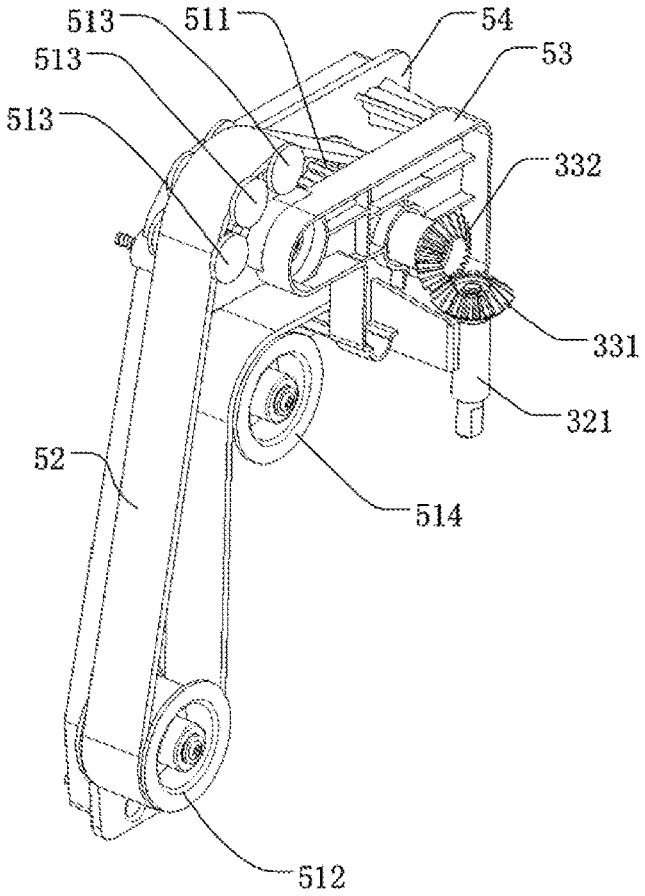
FIG. 22 is a structural schematic view of the steering device on the left front end according to Embodiment 3 of the present invention.
Figure 23:
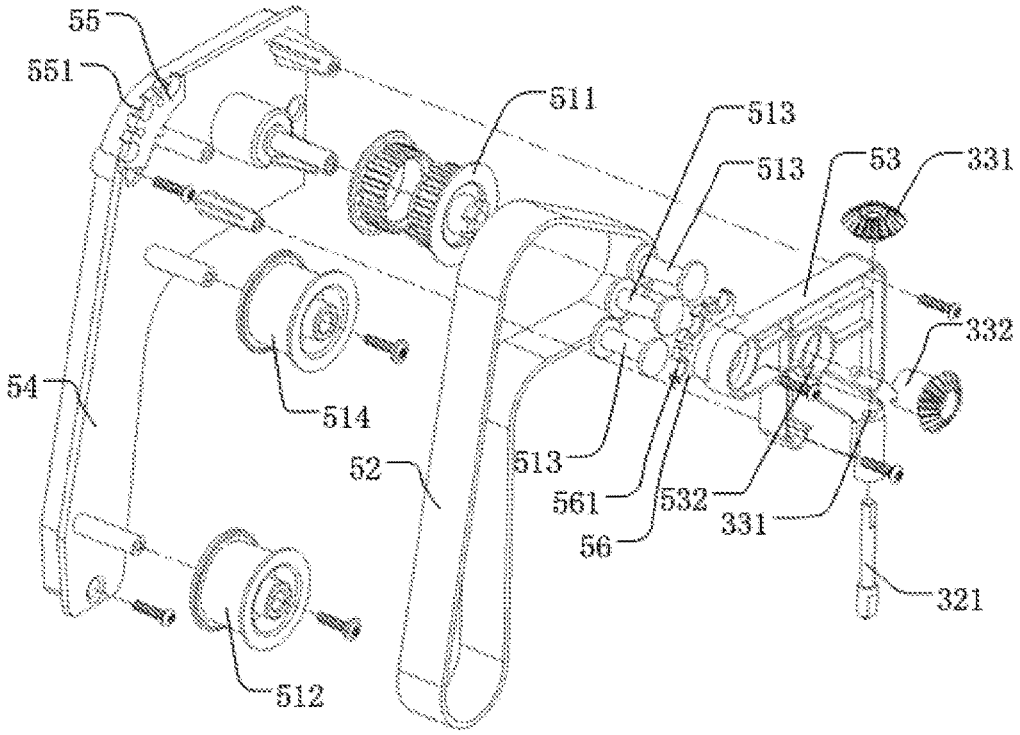
FIG. 23 is an exploded structural schematic view of the steering device on the left front end according to Embodiment 3 of the present invention.
Figure 24:
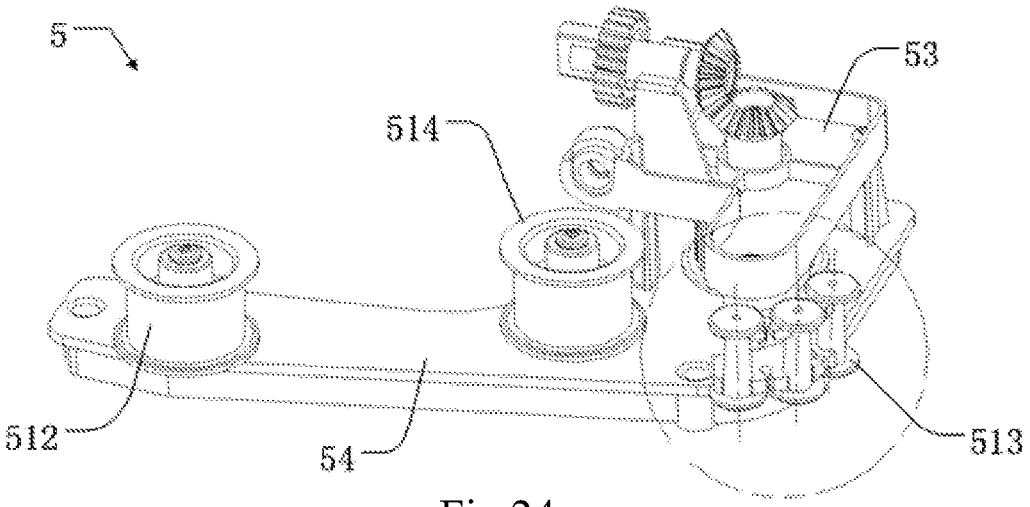
FIG. 24 is a structural schematic view of the steering device on the right front end according to Embodiment 3 of the present invention.

As shown in FIGS. 20 to 21, a distinguishing technical feature between Embodiment 3 and Embodiment 2 is that the cleaning device 2 further includes a non-return sheet baffle 218 protruding from the slag box bottom plate 211 and disposed opposite to the non-return sheet 217. When the center of gravity of the non-return sheet 217 is at the lowest point, the height of the lower edge of the non-return sheet 217 is smaller than the height of the upper edge of the non-return sheet baffle 218; and when the center of gravity of the non-return sheet 217 is moved from a high position to a low position, the non-return sheet 217 is blocked by the non-return sheet baffle 218 at the lowest point of the center of gravity. The non-return sheet 217 can only be rotated towards the inside of the hull 1 and cannot be rotated towards the outside thereof, which will not affect the entry of the debris on the water surface from the water inlet into the slag box 21, and also can effectively prevent the debris from floating out of the slag box 21 from the water inlet.

In Embodiment 1 or 2, the degree of tension of the endless track 52 cannot be adjusted, and on the other hand, if the water surface cleaning machine according to this embodiment contacts an irregularly shaped obstacle during operation, there may be technical problems that the outer surface of the endless track 52 can only partially contact the obstacle, the skidding occurs easily, and the hull is difficult to turn. These problems can be solved if the outer surface of the endless track 52 can vary in depth within a certain range.

As shown in FIGS. 22 to 25, another distinguishing technical feature between Embodiment 3 and Embodiment 2 is that the steering device 5 further includes a first axle mounting plate 55 and a second axle mounting plate 56, the first axle mounting plate 55 is provided at the edge of the wheel set mounting plate 54 and protrudes from the corner portion; the second axle mounting plate 56 is provided at the edge of the bevel gear mounting frame 53, protrudes from the corner portion, and is disposed opposite to the first axle mounting plate 55.

Wherein, the corner bogie wheel 513 is not assembled to the wheel set mounting plate 54 but is rotatably assembled to the first axle mounting plate 55 and the second axle mounting plate 56; the steering device 5 further includes a first axle mounting hole 551 and a second axle mounting hole 561, the first axle mounting hole 551 extends through the edge of the first axle mounting plate 55; the second axle mounting hole 561 extends through the edge of the second axle mounting plate 56, and the second axle mounting hole 561 is disposed opposite to the first axle mounting hole 551 on top of the other.

The first axle mounting hole 551 has an arcuate cross section, and the arc of the arch is larger than a semicircle for placing the cornering bogie wheel 513 stably; the side wall of the first axle mounting plate 55 is provided with a first axle mounting plate opening corresponding to the chord of the arch. A portion of the wheel wall of the corner bogie wheel 513 passes through the first axle mounting plate opening and is exposed outside of the first axle mounting plate 55. The second axle mounting hole 561 has an arcuate cross section, and the arc of the arch is larger than a semicircle; the side wall of the second axle mounting plate 56 is provided with a second axle mounting plate opening corresponding to the chord of the arch. A portion of the wheel wall of the corner bogie wheel 513 passes through the second axle mounting plate opening and is exposed outside of the side wall of the second axle mounting plate 56. The side walls of the two axle mounting holes are open so that the corner bogie wheel 513 can be coated by the endless track 52 and can transmit torque.

The corner bogie wheels 513 may be one or more and may be detachably and rotatably assembled to the first axle mounting plate 55 and the second axle mounting plate 56, the degree of tension of the endless track 52 can be adjusted by changing the number of the corner bogie wheels 513.

The corner bogie wheel 513 includes a corner bogie wheel middle section 5131 and two corner bogie wheel baffles 5132, the corner bogie wheel middle section 5131 is a round pillar having one end rotatably assembled to the first axle mounting hole 551 and the other end thereof rotatably assembled to the second axle mounting hole 561. The two corner bogie wheel baffles 5132 are respectively provided at both ends of the corner bogie wheel middle section 5131, and are respectively provided on the outer side of the first axle mounting plate 55 and the second axle mounting plate 56. Wherein, a portion of the wheel wall of the corner bogie wheel middle section 5131 is exposed outside of the first axle mounting hole 551 and the second axle mounting hole 561 and is coated by a segment of the endless track 52.

Figure 25:
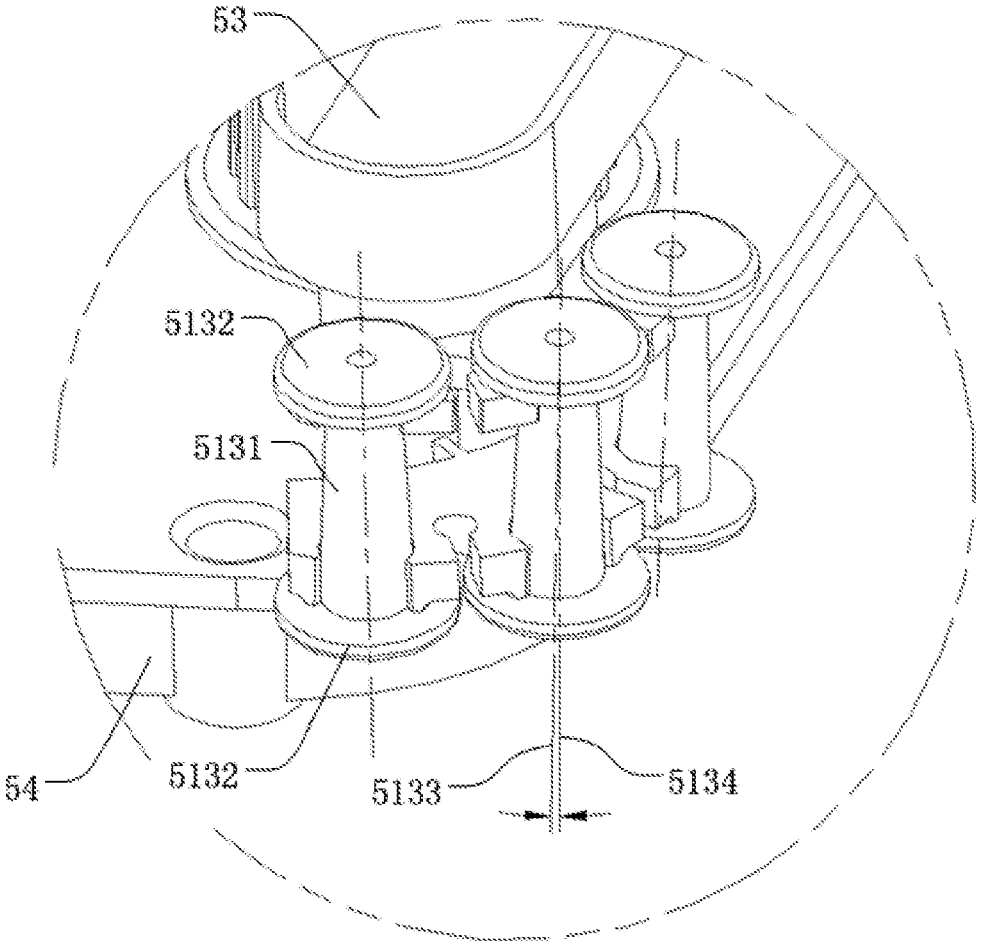
FIG. 25 is a partial enlarged schematic view of the inside of the circle in FIG. 24.

As shown in FIG. 25, the corner bogie wheel 513 is not provided in the vertical direction (plumb line direction), wherein the axis 5133 forms a smaller angle with the plumb line 5134 in the vertical direction. In general, the angle between the central axis of the corner bogie wheel 513 and the plumb line is 2 to 5 degrees.

Since the two axle mounting holes have an arcuate cross section, the chord of the arch corresponds to the opening portion of the axle mounting plate, and the shape of the two axle mounting holes 551 can undergo minor deformation after the force, and thus the corner bogie wheel 513 may be inclined or swung at a certain angle when the endless track 51 is subjected to an external pressure.

When the water surface cleaning machine according to this embodiment contact an irregularly shaped obstacle during operation, since there is a certain pressure between the endless track 52 and the obstacle (the pressure generated by propelling the obstacle by the propulsion device), a plurality of corner bogie wheels 513 provided at the corner portion of the hull 1 are inclined or swung by the force so that the endless track 52 is sufficiently brought into contact with the surface of the obstacle, the contact area is increased so that the friction coefficient between the endless track 52 and the obstacle is larger, thereby avoiding the problems of track skidding, difficult to turn.

The other technical features of Embodiment 3 are the same as those of Embodiment 2 and will not be described again here.

The beneficial effect of this embodiment is to provide a water surface cleaning machine for cleaning up the water area; the hull can turn by itself to bypass the obstacle on the water surface during traveling, thereby avoiding skidding, failing to turn, and failing to move. This embodiment is provided with a non-return sheet and a non-return sheet baffle, which can effectively prevent the debris within the slag box from slipping out of its water inlet; furthermore, the corner bogie wheel is detachable and can be used to adjust the degree of tension of the endless track; the corner bogie wheel is inclined and can be used to reduce the resistance experienced by the endless track, saving the energy consumption of the gear motor.

The preferred specific embodiments of the present invention have been described in detail above. It is to be understood that numerous modifications and variations can be made by those ordinary skilled in the art in accordance with the concepts of the present invention without any inventive effort. Hence, the technical solutions that can be derived by those skilled in the art according to the concepts of the present invention on the basis of the prior art through logical analysis, reasoning and limited experiments should be within the scope of protection defined by the claims.

The invention claimed is:

1. A water surface cleaning machine, comprising:
a hull;
a cleaning device provided at a bottom of the hull for collecting and storing water surface floating debris;
a propulsion device provided at a front end and/or a back end of the hull for propelling the hull to travel on the water surface;
a steering device provided at a corner portion between the front end and a side edge of the hull; the steering device causes the hull to rotate relative to an obstacle for adjusting traveling direction of the hull when the hull comes into contact with the obstacle during traveling on the water surface; and
a power unit provided inside the hull for providing power to the propulsion device and the steering device;
wherein the hull comprises:
a hull plate;
a housing assembled over the hull plate;
an assembly space defined by the housing and the hull plate;
two buoyancy tanks provided on left and right sides below the hull plate and extending in forward and backward directions; and
a water passage defined by the two buoyancy tanks and the hull plate;
wherein the cleaning device comprises:
a slag box inserted into the water passage from the front end of the hull and detachably assembled to the hull;
wherein the slag box comprises:
a slag box bottom plate;
two oppositely disposed slag box side plates perpendicular to the slag box bottom plate;
a slag box front plate, height of an upper edge of which is lower than height of an upper edge of the slag box side plates; a water inlet of the slag box is formed between the upper edge of the slag box front plate and the hull;
a slag box back plate perpendicular to the slag box bottom plate; and
a filter screen provided on the slag box bottom plate and/or the slag box back plate; and
wherein the cleaning device further comprises:
two slag box slide grooves recessed down to outer side walls of the two slag box side plates respectively;
two slag box slide guides protruding from side walls of the two buoyancy tanks on both sides of the water passage respectively and slidably assembled to the two slag box slide grooves;
two slag box bayonets provided in upper portion of back end of the two slag box side plates respectively;
a slag box baffle protruding downward from a bottom of the hull plate;
the slag box slide guides slide along the slag box slide grooves when the slag box is inserted into the water passage; and
the slag box baffle is snapped into the slag box bayonets when the slag box is assembled to the hull.

2. The water surface cleaning machine according to claim 1, wherein the cleaning device comprises:
a non-return sheet provided at the water inlet of the water passage and extending across the water passage; an upper end of the non-return sheet is rotatably assembled to the bottom of the hull and a lower end thereof is rotatable forward and backward.

3. The water surface cleaning machine according to claim 2, wherein the cleaning device comprises:
a non-return sheet baffle protruding from the slag box bottom plate and disposed opposite to the non-return sheet;
a height of a lower edge of the non-return sheet is smaller than a height of an upper edge of the non-return sheet baffle when a center of gravity of the non-return sheet is at the lowest point; and
the non-return sheet is blocked by the non-return sheet baffle at the lowest point of the center of gravity when the center of gravity of the non-return sheet is moved from a high position to a low position.

4. The water surface cleaning machine according to claim 1, wherein the power unit comprises:
a gear motor for outputting a torque;
two first torque transmission mechanisms for transmitting the torque outputted from the gear motor to the propulsion device; and
a second torque transmission mechanism for transmitting the torque outputted from the gear motor to the steering device;
wherein the steering device and the propulsion device introduce a torque synchronously and move in synchronism.

5. The water surface cleaning machine according to claim 4, wherein the gear motor is located on left or right side of the hull;
the gear motor comprises a power output shaft extending in forward and backward directions of the hull;
one end of the power output shaft is connected to one propulsion device via one of the two first torque transmission mechanisms, and another end of the power output shaft is connected to one propulsion device via another of the two first torque transmission mechanisms.

6. The water surface cleaning machine according to claim 4, wherein the second torque transmission mechanism comprises:
a first bevel gear comprising:
first tapered gear teeth; and
a first bevel gear shaft fixedly connected to one transmission shaft; and
a second bevel gear comprising:
second tapered gear teeth drivingly engaged with the first bevel gear shaft; and
a second bevel gear shaft perpendicular to the first bevel gear shaft and connected to a driving wheel of the steering device.

7. The water surface cleaning machine according to claim 4, wherein the propulsion device comprises:
a propeller rotary shaft rotatably assembled to the bottom of the hull; the propeller rotary shaft is connected to the gear motor via the first torque transmission mechanism to introduce a torque; and
at least one vane radially and evenly distributed on a side wall of the propeller rotary shaft;
a lower half of the propulsion device is below the water surface when the hull floats on the water surface; and the vane pushes water when the propeller rotary shaft rotates.

8. The water surface cleaning machine according to claim 1, wherein
the steering device is provided at a left front end and/or a right front end of the hull, and comprises:

a transmission wheel set provided at the corner portion between the front end and a left side edge and/or a right side edge of the hull; and an endless track enclosing the transmission wheel set and being in a tensioned state, a segment of the endless track is positioned at one corner portion by the transmission wheel set and protrudes from the hull.

9. The water surface cleaning machine according to claim 8, wherein the transmission wheel set comprises:

a driving wheel connected to a transmission shaft via the second torque transmission mechanism to introduce a torque;

a front bogie wheel provided at a foremost end of the hull; and a corner bogie wheel provided at a leftmost or rightmost end of a front portion of the hull;

wherein a portion of the wheel wall of the driving wheel, the front bogie wheel and the corner bogie wheel is tangent to an inner surface of the endless track.

10. The water surface cleaning machine according to claim 9, wherein the steering device comprises:

a bevel gear mounting frame disposed opposite to a portion of the endless track and fixedly connected to the hull;

the bevel gear mounting frame comprises:

a first bevel gear mounting hole in which a first bevel gear is rotatably assembled; and a second bevel gear mounting hole in which a second bevel gear is rotatably assembled;

the steering device further comprises:

a wheel set mounting plate disposed opposite to the endless track and fixedly connected to the hull;

wherein the driving wheel, the front bogie wheel and the corner bogie wheel are rotatably assembled to the wheel set mounting plate;

the steering device further comprises:

a locating bogie wheel rotatably assembled to the wheel set mounting plate, a portion of an outer surface thereof being tangent to an outer surface of the endless track;

projections of a central axis of the driving wheel, a central axis of the front bogie wheel and a central axis of the corner bogie wheel on the wheel set mounting plate define a triangular region; and a projection of a central axis of the locating bogie wheel on the wheel set mounting plate is within the triangular region.

11. The water surface cleaning machine according to claim 10, wherein the steering device further comprises:

a first axle mounting plate provided at an edge of the wheel set mounting plate and protruding from the corner portion; and a second axle mounting plate provided at an edge of the bevel gear mounting frame, protruding from the corner portion, and disposed opposite to the first axle mounting plate;

wherein the corner bogie wheel is rotatably assembled to the first axle mounting plate and the second axle mounting plate; a portion of the wheel wall of the corner bogie wheel is exposed outside of the first axle mounting plate and the second axle mounting plate.

12. The water surface cleaning machine according to claim 11, wherein the steering device further comprises:

a first axle mounting hole extending through an edge of the first axle mounting plate; and a second axle mounting hole extending through an edge of the second axle mounting plate and disposed opposite to the first axle mounting hole; and the corner bogie wheel comprises:

a corner bogie wheel middle section which is a round pillar having one end rotatably assembled to the first axle mounting hole and the other end rotatably assembled to the second axle mounting hole; and two corner bogie wheel baffles respectively provided at both ends of the corner bogie wheel middle section, and respectively provided on an outer side of the first axle mounting plate and the second axle mounting plate;

wherein a portion of the wheel wall of the corner bogie wheel middle section is exposed outside of the hull and is coated by a segment of the endless track.

13. The water surface cleaning machine according to claim 12, wherein the first axle mounting hole has an arcuate cross section, a side wall of which is provided with a first axle mounting plate opening;

the second axle mounting hole has an arcuate cross section, a side wall of which is provided with a second axle mounting plate opening; and wherein a portion of the wheel wall of the corner bogie wheel passes through the first axle mounting plate opening and the second axle mounting plate opening and is exposed outside of the hull;

and/or the corner bogie wheel is inclined by the pressure of the endless track;

in the inclined state, a central axis of the corner bogie wheel forms an angle of 2 to 5 degrees with respect to a vertical direction.

14. The water surface cleaning machine according to claim 9, wherein the inner surface of the endless track is provided with engaging teeth;

the driving wheel is a toothed pulley;

the endless track is drivingly engaged with the toothed pulley via the engaging teeth.

15. The water surface cleaning machine according to claim 1, further comprising:

an anti-skid device provided at the corner portion between the back end and the side edge of the hull and protruding from the back end and/or the side edge of the hull;

and/or the cleaning device comprises a gathering sweeping member which protruding from the corner portion between the front end and the side edge of the hull.

* * * * *